US011414972B2

(12) United States Patent
Al-Nakhli et al.

(10) Patent No.: US 11,414,972 B2
(45) Date of Patent: Aug. 16, 2022

(54) METHODS AND APPARATUS FOR SPATIALLY-ORIENTED CHEMICALLY-INDUCED PULSED FRACTURING IN RESERVOIRS

(71) Applicant: Saudi Arabian Oil Company, Dhahran (SA)

(72) Inventors: Ayman R. Al-Nakhli, Dammam (SA); Sameeh Issa Batarseh, Dhahran (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 16/952,760

(22) Filed: Nov. 19, 2020

(65) Prior Publication Data

US 2021/0071512 A1 Mar. 11, 2021

Related U.S. Application Data

(62) Division of application No. 15/342,317, filed on Nov. 3, 2016, now Pat. No. 10,989,029.
(Continued)

(51) Int. Cl.
*E21B 43/26* (2006.01)
*E21B 43/267* (2006.01)
(Continued)

(52) U.S. Cl.
CPC ..... *E21B 43/26* (2013.01); *E21B 29/02* (2013.01); *E21B 43/263* (2013.01); *E21B 17/1078* (2013.01)

(58) Field of Classification Search
None
See application file for complete search history.

(56) References Cited

U.S. PATENT DOCUMENTS 1,819,055 A 8/1931 Jan et al.
1,990,969 A 2/1935 Wilson
(Continued)

FOREIGN PATENT DOCUMENTS

CA 2855780 5/2013
CN 101323780 A 12/2008
(Continued)

OTHER PUBLICATIONS

Al-Nakhli, Chemically-Induced Pressure Pulse to Increase Stimulated Reservoir Volume in Unconventional Reservoirs, Unconventional Resources Technology Conference, Denver, CO, Aug. 25-27, 2014.

(Continued)

*Primary Examiner* — Charles R Nold
(74) *Attorney, Agent, or Firm* — Bracewell LLP; Constance Gall Rhebergen

(57) ABSTRACT

Apparatus and methods for spatially orienting a subterranean pressure pulse to a hydrocarbon-bearing formation. The apparatus includes an injection body with a fixed shape, where the injection body is operable to hold an exothermic reaction component prior to triggering an exothermic reaction of the exothermic reaction component, and where the injection body maintains the fixed shape during and after triggering of the exothermic reaction component. The injection body includes a chemical injection port, where the chemical injection port is operable to feed components of the exothermic reaction component to the injection body. The injection body includes a reinforced plug, where the reinforced plug is operable to direct a pressure pulse generated by the exothermic reaction component within the injection body to a perforation to generate a spatially-oriented fracture, where spatial orientation of the spatially-oriented fracture is pre-determined.

15 Claims, 11 Drawing Sheets

Related U.S. Application Data

(60) Provisional application No. 62/251,611, filed on Nov. 5, 2015.

(51) Int. Cl.

| | |
|---|---|
| ***E21B 29/02*** | (2006.01) |
| ***E21B 17/10*** | (2006.01) |
| ***E21B 43/263*** | (2006.01) |

(56) References Cited

U.S. PATENT DOCUMENTS

| | | | |
|---|---|---|---|
| 2,094,479 | A | 9/1937 | Vandergrift |
| 2,288,556 | A | 6/1942 | Vollmer |
| 2,466,674 | A | 4/1949 | Mullady |
| 2,548,463 | A | 4/1951 | Blood |
| 2,606,813 | A | 8/1952 | Kahr |
| 2,699,213 | A | 1/1955 | Cardwell et al. |
| 2,885,004 | A | 5/1959 | Perry |
| 3,025,911 | A | 3/1962 | Bergman |
| 3,354,954 | A | 11/1967 | Buxton |
| 3,385,360 | A | 5/1968 | Smith |
| 3,405,761 | A | 10/1968 | Parker |
| 3,476,183 | A | 11/1969 | Haynes, Jr. et al. |
| 3,483,923 | A | 12/1969 | Darley |
| 3,543,856 | A | 12/1970 | Knox et al. |
| 3,568,772 | A | 3/1971 | Gogarty et al. |
| 3,576,596 | A | 4/1971 | Kranc et al. |
| 3,707,192 | A | 12/1972 | Goins, Jr. et al. |
| 3,712,380 | A | 1/1973 | Caffey |
| 3,719,228 | A | 3/1973 | Garcia |
| 3,760,881 | A | 9/1973 | Kiel |
| 3,828,854 | A | 8/1974 | Templeton et al. |
| 3,864,451 | A | 2/1975 | Lee et al. |
| 4,056,146 | A | 11/1977 | Hall |
| 4,085,799 | A | 4/1978 | Bousaid et al. |
| 4,119,150 | A | 10/1978 | Froelich |
| 4,136,739 | A | 1/1979 | Salathiel et al. |
| 4,158,042 | A | 6/1979 | Deutschman |
| 4,178,993 | A | 12/1979 | Richardson et al. |
| 4,210,628 | A | 7/1980 | Ninomiya et al. |
| 4,219,083 | A | 8/1980 | Richardson et al. |
| 4,232,740 | A | 11/1980 | Park |
| 4,232,741 | A | 11/1980 | Richardson et al. |
| 4,291,765 | A | 9/1981 | Gilchrist et al. |
| 4,330,037 | A | 5/1982 | Richardson et al. |
| 4,345,650 | A | 8/1982 | Wesley |
| 4,391,337 | A | 7/1983 | Ford et al. |
| 4,399,868 | A | 8/1983 | Richardson et al. |
| 4,410,041 | A | 10/1983 | Davies et al. |
| 4,414,118 | A | 11/1983 | Murphey |
| 4,454,918 | A | 6/1984 | Richardson et al. |
| 4,475,595 | A | 10/1984 | Watkins et al. |
| 4,482,016 | A | 11/1984 | Richardson |
| 4,485,007 | A | 11/1984 | Tam et al. |
| 4,491,180 | A | 1/1985 | Brown et al. |
| 4,518,040 | A | 5/1985 | Middleton |
| 4,572,297 | A | 2/1986 | Thigpen et al. |
| 4,615,391 | A | 10/1986 | Garthoffner |
| 4,683,951 | A | 8/1987 | Pathak et al. |
| 4,703,803 | A | 11/1987 | Blumer |
| 4,832,123 | A | 5/1989 | Abou-Sayed et al. |
| 4,842,073 | A | 6/1989 | Himes et al. |
| 4,846,277 | A | 7/1989 | Khalil et al. |
| 4,865,826 | A | 9/1989 | Carnell et al. |
| 4,898,750 | A | 2/1990 | Friedman et al. |
| 4,919,209 | A | 4/1990 | King |
| 5,082,054 | A | 1/1992 | Kiamanesh |
| 5,082,058 | A | 1/1992 | Blumer |
| 5,087,350 | A | 2/1992 | Paris-Marcano |
| 5,152,906 | A | 10/1992 | Aften et al. |
| 5,183,581 | A | 2/1993 | Khalil et al. |
| 5,197,544 | A | 3/1993 | Himes |
| 5,209,295 | A | 5/1993 | Hernandez et al. |
| 5,308,650 | A | 5/1994 | Krummel et al. |
| 5,342,530 | A | 8/1994 | Aften et al. |
| 5,346,778 | A | 9/1994 | Ewan et al. |
| 5,358,565 | A | 10/1994 | Shu |
| 5,375,660 | A | 12/1994 | Wehunt |
| 5,411,093 | A | 5/1995 | Jennings, Jr. |
| 5,411,094 | A | 5/1995 | Northrop |
| 5,639,313 | A | 6/1997 | Khalil |
| 5,958,224 | A | 9/1999 | Ho et al. |
| 6,035,933 | A | 3/2000 | Khalil et al. |
| 6,176,313 | B1 | 1/2001 | Coenen et al. |
| 6,277,271 | B1 | 8/2001 | Kocal |
| 6,500,219 | B1 | 12/2002 | Gunnerman |
| 6,554,071 | B1 | 4/2003 | Reddy et al. |
| 6,662,874 | B2 | 12/2003 | Surjaatmadja et al. |
| 6,722,434 | B2 | 4/2004 | Reddy et al. |
| 6,802,875 | B1 | 10/2004 | Kimbara et al. |
| 6,827,845 | B2 | 12/2004 | Gong et al. |
| 6,841,279 | B1 | 1/2005 | Foger et al. |
| 6,880,646 | B2 | 4/2005 | Batarseh |
| 6,881,325 | B2 | 4/2005 | Morris et al. |
| 6,972,119 | B2 | 12/2005 | Taguchi et al. |
| 6,986,392 | B2 | 1/2006 | Chatterji et al. |
| 6,992,048 | B2 | 1/2006 | Reddy et al. |
| 7,029,639 | B2 | 4/2006 | Yasutake et al. |
| 7,059,414 | B2 | 6/2006 | Rae et al. |
| 7,066,260 | B2 | 6/2006 | Sullivan et al. |
| 7,086,484 | B2 | 8/2006 | Smith |
| 7,097,925 | B2 | 8/2006 | Keefer |
| 7,153,434 | B1 | 12/2006 | Dennis |
| 7,326,329 | B2 | 2/2008 | Gomez |
| 7,328,746 | B2 | 2/2008 | Al-Taq et al. |
| 7,399,328 | B2 | 7/2008 | Ukai et al. |
| 7,461,693 | B2 | 12/2008 | Cogliandro et al. |
| 7,540,328 | B2 | 6/2009 | Brown et al. |
| 7,589,050 | B2 | 9/2009 | Frenier et al. |
| 7,624,743 | B2 | 12/2009 | Sarkar et al. |
| 7,686,084 | B2 | 3/2010 | Reddy et al. |
| 7,779,915 | B2 | 8/2010 | Hutchins et al. |
| 7,875,402 | B2 | 1/2011 | Hershkowitz et al. |
| 7,883,803 | B2 | 2/2011 | McElroy et al. |
| 7,947,629 | B2 | 5/2011 | Fuller |
| 8,008,067 | B2 | 8/2011 | Geddes et al. |
| 8,096,361 | B2 | 1/2012 | Willberg |
| 8,122,950 | B2 | 2/2012 | Daniel et al. |
| 8,132,628 | B2 | 3/2012 | Sanders et al. |
| 8,215,393 | B2 | 7/2012 | Mackay et al. |
| 8,216,344 | B2 | 7/2012 | Degenstein et al. |
| 8,235,140 | B2 | 8/2012 | Wideman |
| 8,282,715 | B1 | 10/2012 | Degenstein et al. |
| 8,347,965 | B2 | 1/2013 | Gray et al. |
| 8,365,823 | B2 | 2/2013 | Dreher, Jr. et al. |
| 8,464,789 | B2 | 6/2013 | Banerjee et al. |
| 8,962,536 | B2 | 2/2015 | Winslow et al. |
| 8,967,293 | B2 | 3/2015 | Von Rohr |
| 9,027,641 | B2 | 5/2015 | Potapenko et al. |
| 9,217,291 | B2 | 12/2015 | Batarseh |
| 9,334,721 | B2 | 5/2016 | Al Dossary et al. |
| 9,338,667 | B2 | 5/2016 | Ma |
| 9,488,042 | B2 | 11/2016 | Al-Otaibi et al. |
| 9,730,392 | B2 | 8/2017 | De Gersem et al. |
| 10,032,480 | B2 | 7/2018 | Fisher |
| 10,047,277 | B2 | 8/2018 | Al-Dahlan et al. |
| 10,151,186 | B2 | 12/2018 | Al-Nakhli |
| 2003/0092581 | A1 | 5/2003 | Crews |
| 2003/0143448 | A1 | 7/2003 | Keefer |
| 2003/0221831 | A1 | 12/2003 | Reddy et al. |
| 2004/0031388 | A1 | 2/2004 | Hsu |
| 2004/0234827 | A1 | 11/2004 | Fujihara et al. |
| 2005/0000694 | A1 | 1/2005 | Dalrymple et al. |
| 2005/0123810 | A1 | 6/2005 | Balan |
| 2005/0215439 | A1 | 9/2005 | Blair |
| 2006/0144591 | A1 | 7/2006 | Gonzalez et al. |
| 2006/0154814 | A1 | 7/2006 | Zanibelli et al. |
| 2006/0229212 | A1 | 10/2006 | Willberg et al. |
| 2006/0258541 | A1 | 11/2006 | Crews |
| 2007/0215345 | A1 | 9/2007 | Lafferty et al. |
| 2008/0066784 | A1 | 3/2008 | Sarkar et al. |
| 2008/0069961 | A1 | 3/2008 | Sarkar et al. |
| 2008/0119374 | A1 | 5/2008 | Willberg et al. |
| 2008/0121395 | A1 | 5/2008 | Reddy et al. |

(56) References Cited

U.S. PATENT DOCUMENTS

| | | | |
|---|---|---|---|
| 2008/0156482 | A1 | 7/2008 | Gubar et al. |
| 2008/0190607 | A1 | 8/2008 | Minnich et al. |
| 2008/0190610 | A1 | 8/2008 | Barmatov et al. |
| 2008/0258541 | A1 | 10/2008 | Kamikawa et al. |
| 2008/0289828 | A1 | 11/2008 | Hutchins et al. |
| 2008/0318812 | A1 | 12/2008 | Kakadjian, Sr. et al. |
| 2009/0042748 | A1 | 2/2009 | Fuller |
| 2009/0098467 | A1 | 4/2009 | Lowe et al. |
| 2009/0107680 | A1 | 4/2009 | Surjaatmadja |
| 2009/0155649 | A1 | 6/2009 | Cui et al. |
| 2009/0155650 | A1 | 6/2009 | Cui et al. |
| 2009/0260818 | A1 | 10/2009 | Daniel et al. |
| 2010/0056399 | A1 | 3/2010 | Berkland et al. |
| 2010/0155303 | A1 | 6/2010 | Toida et al. |
| 2010/0170453 | A1 | 7/2010 | Betzer-Zilevitch |
| 2010/0252267 | A1 | 10/2010 | Harris et al. |
| 2010/0263867 | A1 | 10/2010 | Horton et al. |
| 2010/0288499 | A1 | 11/2010 | Al-Dhafeeri et al. |
| 2011/0030958 | A1 | 2/2011 | Fedorov et al. |
| 2011/0203797 | A1 | 8/2011 | Alexandrov et al. |
| 2011/0220360 | A1 | 9/2011 | Lindvig et al. |
| 2012/0211225 | A1 | 8/2012 | Kostrov et al. |
| 2012/0305255 | A1 | 12/2012 | Zabolzhskiy et al. |
| 2013/0123151 | A1 | 5/2013 | Crews |
| 2013/0126038 | A1 | 5/2013 | Jamal |
| 2013/0126164 | A1 | 5/2013 | Sweatman et al. |
| 2013/0126169 | A1 | 5/2013 | Al-Nakhli et al. |
| 2013/0126175 | A1 | 5/2013 | Al-Mulhem et al. |
| 2013/0161012 | A1 | 6/2013 | Al-Dahlan et al. |
| 2013/0180720 | A1 | 7/2013 | Al-Dahlan et al. |
| 2014/0041940 | A1 | 2/2014 | Shnell |
| 2014/0060839 | A1 | 3/2014 | Wang et al. |
| 2014/0069644 | A1 | 3/2014 | Reddy et al. |
| 2014/0069647 | A1 | 3/2014 | Daly |
| 2014/0090839 | A1 | 4/2014 | Al-Nakhli et al. |
| 2014/0116701 | A1 | 5/2014 | Tang |
| 2014/0144632 | A1 | 5/2014 | Zavolzhski et al. |
| 2014/0238678 | A1 | 8/2014 | Arrell, Jr. et al. |
| 2014/0290951 | A1 | 10/2014 | Al-Taq et al. |
| 2014/0357893 | A1 | 12/2014 | Peters |
| 2015/0000912 | A1 | 1/2015 | Choudhary et al. |
| 2015/0114646 | A1 | 4/2015 | Friedheim et al. |
| 2015/0175879 | A1 | 6/2015 | Al-Nakhli et al. |
| 2015/0240613 | A1 | 8/2015 | Potapenko et al. |
| 2015/0300142 | A1 | 10/2015 | Al-Nakhli et al. |
| 2015/0300143 | A1 | 10/2015 | Al-Nakhli et al. |
| 2015/0337638 | A1 | 11/2015 | Lawrence et al. |
| 2015/0345225 | A1 | 12/2015 | Kocis |
| 2016/0032654 | A1 | 2/2016 | Cawthon et al. |
| 2016/0158880 | A1 | 6/2016 | Koitzsch |
| 2016/0160618 | A1 | 6/2016 | Batarseh |
| 2016/0264859 | A1 | 9/2016 | Al-Nakhli et al. |
| 2016/0319182 | A1 | 11/2016 | Al-Nakhli et al. |
| 2017/0130568 | A1 | 5/2017 | Al-Nakhli et al. |
| 2017/0130570 | A1 | 5/2017 | Al-Nakhli et al. |

FOREIGN PATENT DOCUMENTS

| | | | |
|---|---|---|---|
| CN | 101839123 | A | 9/2010 |
| CN | 103999277 | | 8/2014 |
| CN | 104625437 | A | 5/2015 |
| DE | 19543534 | | 2/1997 |
| EP | 0654582 | A1 | 5/1995 |
| EP | 0909873 | A2 | 4/1999 |
| EP | 1767845 | A1 | 3/2007 |
| EP | 2783413 | | 10/2014 |
| GB | 2288197 | A | 10/1995 |
| JP | 2001019984 | A | 1/2001 |
| JP | 2005015533 | A | 1/2005 |
| JP | 2006221850 | A | 8/2006 |
| JP | 2007016975 | A | 1/2007 |
| JP | 2009155190 | A | 7/2009 |
| JP | 2015507813 | | 3/2015 |
| KR | 20140098158 | | 8/2014 |
| RU | 2100583 | C1 | 12/1997 |
| RU | 2126084 | C1 | 2/1999 |
| RU | 2194156 | C1 | 12/2002 |
| RU | 2194852 | C1 | 12/2002 |
| SU | 1677260 | A1 | 9/1991 |
| WO | 0037777 | A1 | 6/2000 |
| WO | 2006131895 | A1 | 12/2006 |
| WO | 2007015391 | A1 | 2/2007 |
| WO | 2008032067 | A1 | 3/2008 |
| WO | 2009009370 | A1 | 1/2009 |
| WO | 2009070561 | A1 | 6/2009 |
| WO | 2010046618 | A1 | 4/2010 |
| WO | 2010047612 | A1 | 4/2010 |
| WO | 2012012224 | A1 | 1/2012 |
| WO | 2012025150 | A1 | 3/2012 |
| WO | 2012082402 | A2 | 6/2012 |
| WO | 2013078142 | A2 | 5/2013 |
| WO | 2013078306 | A1 | 5/2013 |
| WO | 2015094159 | A1 | 6/2015 |
| WO | 2015155589 | A1 | 10/2015 |

OTHER PUBLICATIONS

Anning Zhou et al., Deep Desulfurization of Diesel Fuels by Selective Adsorption with Activated Carbons, American Chemical Society, Washington, DC, vol. 49, No. 3, Jul. 1, 2004, pp. 329-332.

Antonio Chica, "Catalytic Oxidative Desulfurization (ODS) of Diesel Fuel on a Continuous Fixed-Bed Reactor," Journal of Catalysis, vol. 242, 2006, pp. 229-308.

Ashton, J.P., et al., "In-Situ Heat System Stimulates Paraffinic-Crude Producers in Gulf of Mexico," SPE 15660, SPE Production Engineering, May 1989, pp. 157-160, vol. 4, No. 2, Society of Petroleum Engineers.

Cheng Yun-Fu, Preparation and Field Uses of Heat Generating Hydrofracturing Fluids, Oilfield Chemistry Research Institute of Drilling and Production, Dagang Oil Fields, Dagang Oilfield Group Co., Ltd., vol. 14, No. pp. 24-27, Mar. 25, 1997.

Non-Final Office Action for related U.S. Appl. No. 13/683,272, dated Feb. 23, 2015.

Cuderman, J.F. et al., "Tailored-Pulse Fracturing in Cased and Perforated Boreholes", SPE 15253, 1986, pp. 1-10, Society of Petroleum Engineers.

Database WPI, Week 201115, XP-002693470, Thomson Scientific, London, GB, Sep. 2010, C:\EPOPROGS\SEA\.\..\..\epodata\sea\eplogf\internal.log.

E. Raymundo-Pinero, "Temperature Programmed Desorption Study on the Mechanism of SO2 oxidation by Activated Carbon and Activated Carbon Fibres," Carbon, vol. 39, 2001, pp. 231-242.

European Search Report and Written Opinion dated Aug. 2, 2013, for related European Patent Application 13174172.

Examination Report dated Jun. 28, 2011 for related European Patent Application No. 08857250.9.

Gao, X. "Adsorption and Reduction of NO2 Over Activated Carbon at Low Temperature," Fuel Processing Technology 92, 2011,pp. 139-146.

International Search Report and Written Opinion for related PCT application PCT/US2016/060247 dated Jan. 20, 2017; 14 pages.

International Search Report and Written Opinion for related PCT application PCT/US2016/060267, dated Jan. 26, 2017; 15 pages.

Isao Mochida, "Adsorption and Adsorbed Species of SO2 during its Oxidative Removal over Pitch-Based Activated Carbon Fibers," Energy & Fuels, vol. 13, No. 2, 1999, pp. 369-373.

Isao Mochida, Kinetic Study of the Continuous Removal of SOx on Polyacrylonnitrile-Based Activated Carbon Fibres, Fuel vol. 76, No. 6, 1997, pp. 533-536.

Isao Mochida, "Removal of SOx and NOx over activated carbon fibers," Carbon, vol. 38, 2000 pp. 227-239.

Khalil, C.N., et al., "Detection of Formation Damage Associated to Paraffin in Reservoirs of the Reconcavo Baiano, Brazil," SPE 37238, Int'l Symposium on Oilfield Chemistry held in Houston, TX, Feb. 18-21, 1997, Society of Petroleum Engineers, Inc.

Kiryukhin, et al., Thermal-Hydrodynamic Modeling of Laboratory Tests on the Interaction of NaNO3—NaOH Fluids with Sandstone Rock at a Deep Radionuclide Repository Site, Dec. 2007, pp. 1-20, Russia.

(56) References Cited

OTHER PUBLICATIONS

Marques, L.C.C., et al., "A New Technique to Solve Gas Hydrate Problems in Subsea Christmas Trees." SPE 77572, SPE Production & Facilities, Nov. 2004, pp. 253-258, Society of Petroleum Engineers.
Mure Te, "Oxidation Reactivities of Dibenzothiophenes in Polyoxometalate/H202 and Formic Acid/H202 Systems," Applied Catalysis A: General 219, 2001, pp. 267-280.
N. Shirahama, "Mechanistic Study on Adsorption and Reduction of NO2 Over Activated Carbon Fibers," Carbon, vol. 40, 2002, pp. 2605-2611.
Paolo DeFilippis, "Oxidative Desulfurization: Oxidation Reactivity of Sulfur Compounds in Different Organic Matrixes," Energy & Fuels, vol. 17, No. 6, 2003, pp. 1452-1455.
PCT International Search Report and the written opinion dated Apr. 8, 2014; International Application No. PCT/US2013/043076; International filing date May 29, 2013.
PCT International Search Report and the Written Opinion of the International Searching Authority dated Dec. 20, 2013; International Application No. PCT/US2012/065907; International File Date: Nov. 19, 2012.
PCT Notification of Transmittal of the International Search Report and the Written Opinion of the International Searching Authority, or the Declaration; dated Mar. 18, 2013; International Appln No. PCT/US2013/021961; Int'l File Date: Jan. 17, 2013.
PCT Notification of Transmittal of the International Search Report and the Written Opinion of the International Searching Authority, or the Declaration; dated Mar. 5, 2013; International Appln No. PCT/US2012/066249; Int'l File Date: Nov. 21, 2012.
Sampanthar, J. "A Novel Oxidative Desulfurization Process to Remove Refractory Sulfur Compounds From Diesel Fuel," Applied Catalysis B: Environmental 63, 2006, pp. 85-93.
Sano, Y. "Two-step Adsorption Process for Deep Desulfurization of Diesel Oil," Fuel 84 (2005) 903-910.
Sano, Y. et al., Selection and Further Activation of Activated Carbons for Removal of Nitrogen Species in Gas Oil as a Pretreatment for its Deep Hydrodesulfurization, Energy & Fuels, vol. 18, Mar. 20, 2004, pp. 644-651.
Sano, Y., "Adsorptive Removal of Sulfur and Nitrogen Species from a Straight Run Gas Oil Over Activated Carbons for its Deep Hydrodesulfurization," Applied Catalysis B: Environmental 49, 2004, pp. 219-225.
Satoru Murata, "A Novel Oxidative Desulfurization System for Diesel Fuels with Molecular Oxygen in the Presence of Cobalt Catalysts and Aldehydes," Energy & Fuels, vol. 18, No. 1, 2004, pp. 116-121.
Schlumberger Systems, Sand Control Pumping, pp. 37-70, USA, available at www.slb.com/~/media/files/sand_control/.../scps_03_systems.ashx. Feb. 27, 2012.
Shujiro Otsuki, "Oxidative Desulfurization of Light Gas Oi and Vacuum Gas Oil by Oxidation and Solvent Extraction," Energy & Fuels, vol. 14, No. 6, 2000, pp. 1232-1239.
Singapore Search Report and Written Opinion for Related Singapore Application No. 11201402220U, dated Jan. 5, 2015.
Timmermann et al., Kinetics of (reversible) internal reforming of methane in solid oxide fuel cells under stationary and APU conditions, Abstract, Journal of Power Sources, Jan. 2010.
U.S. Appl. No. 15/385,105, filed Dec. 20, 2016 "Non-Acidic-Exothermic Sandstone Stimulation Fluids"; pp. 1-28; figures 1-3.
Yazu, K.; "Immobolized Tungstophosphoric Acid-Catalyzed Oxidative Desulfurization of Diesel Oil with Hydrogen Peroxide," Journal of Japan Petroleum Institute, vol. 46, No. 6, 2003, pp. 379-382.
Yazu, K.; "Oxidative Desulfurization of Diesel Oil with Hydrogen Peroxide in the Presence of Acid Catalyst in Diesel Oil/Acetic Acid Biphase System," Chemistry Letters, vol. 33, No. 10, 2004, pp. 1306-1307.

METHODS AND APPARATUS FOR SPATIALLY-ORIENTED CHEMICALLY-INDUCED PULSED FRACTURING IN RESERVOIRS

PRIORITY

This application is a divisional application of and claims priority to and the benefit of U.S. Non-Provisional patent application Ser. No. 15/342,317, filed Nov. 3, 2016, which itself claims priority to and the benefit of U.S. Prov. App. Ser. No. 62/251,611, filed Nov. 5, 2015, the entire disclosures of which are incorporated here by reference.

FIELD

This disclosure relates to apparatus and methods for spatially orienting or directing a chemically-induced pulse. More specifically, this disclosure relates to spatially orienting a chemically-induced pressure pulse in a hydrocarbon-bearing reservoir.

BACKGROUND

Hydraulic fracturing fluids containing proppants are used extensively to enhance productivity from hydrocarbon-bearing reservoir formations, including carbonate and sandstone formations. During hydraulic fracturing operations, a fracturing treatment fluid is pumped under a pressure and rate sufficient for cracking the formation of the reservoir and creating a fracture. Fracturing operations usually consist of three main stages including a pad fluid stage, a proppant fluid stage, and an overflush fluid stage. The pad fluid stage typically consists of pumping a pad fluid into the formation. The pad fluid is a viscous, gelled fluid which initiates and propagates the fractures. The proppant fluid stage involves pumping a proppant fluid into the fractures of the formation. The proppant fluid contains proppants mixed with a viscous, gelled fluid or a visco-elastic surfactant fluid. The proppants in the proppant fluid are lodged in the fractures and create conductive fractures through which hydrocarbons flow. The final stage, the overflush stage, includes pumping a viscous gelled fluid into the fractures to ensure the proppant fluid is pushed inside the fractures.

Unconventional gas wells require an extensive fracturing network to increase the stimulated reservoir volume and to create commercially producing wells. One commonly employed technique is multi-stage hydraulic fracturing in horizontal wells, which is very costly and may not provide the required stimulated reservoir volume. Moreover, traditional hydraulic fracturing methods use huge amounts of damaging gels pumped downhole as noted previously. Even with traditional breakers, significant amounts of polymeric material cannot be recovered and, therefore, fracture conductivity is reduced.

Fracking technologies that are currently used have an array of deficiencies: 1) hydraulic fracturing has the longest pressure rise time and creates a single radial fracture; 2) explosives downhole have the shortest rise time and generate compacted zones with multiple radial fractures; 3) propellants have intermediate pressure rise time with multiple fractures. Formation damage is another problem. Explosives create a damaged zone, impairing permeability and communication with the reservoir. Hydraulic fracturing induces fracture damage which retains viscous fracturing fluids near the fracture area and blocks gas flow. Propellants introduce the risk of oxidation, and require special tools with rig operations.

Horizontal drilling and multi-stage hydraulic fracturing have produced gas from shale and tight sand formations; however, the primary recovery factors are less than 20%. Unconventional reserves trapped within very low permeability formations, such as tight gas or shale formations, exhibit little or no production. These are economically undesirable to develop with existing conventional recovery methods. Such reservoirs require a large fracture network with high fracture conductivity to maximize well performance.

SUMMARY

The disclosure relates to apparatus and methods for directing a chemically-induced pulse. More specifically, the disclosure relates to spatially orienting a chemically-induced pressure pulse in a hydrocarbon-bearing reservoir. As explained previously, there are high costs, blockages, and other disadvantages associated with conventional hydraulic fracturing, and therefore apparatus and methods that increase the stimulated reservoir volume of unconventional gas wells are desired.

In embodiments of the present disclosure, reactive chemicals are combined to induce a spatially-oriented pressure pulse and create multiple fractures, optionally including a fracture network and auxiliary fractures, in a hydrocarbon-bearing reservoir. Induced fractures are created proximate a wellbore or any other desired fracturing area. Embodiments of the apparatus and method are designed to execute downhole exothermic reaction stimulation and to create spatially-oriented fractures around the wellbore to enhance productivity from a hydrocarbon-bearing reservoir. Embodiments of the apparatus and method can be applied in both an open-hole wellbore and a wellbore with casing. Embodiments of the apparatus provide multiple advantages, including the ability to orient exothermic energy in a desired and pre-determined direction and the ability to create several fractures in multiple desired directions in a single pulse by utilizing a rotational orientation director.

Other advantages of the present disclosure include increasing the stimulated reservoir volume in unconventional reservoirs and tight gas developments, and therefore enhancing the productivity of these reservoirs. Certain embodiments also enable fracturing of high-stress rocks and deep unconventional reservoirs, where conventional hydraulic fracturing methods have failed to fracture the formations.

With embodiments of the disclosure, pressurizing time can be controlled, so fracturing patterns can be optimized. Chemically-induced pressure pulse fracturing allows for inert gas expansion, creates multiple fractures, and also can be spatially oriented into one dominant fracture using niches and perforations. Embodiments of a tool have been designed to create multiple spatially-oriented fractures in open or cased hole wells. The fracturing technology disclosed overcomes previous challenges: no compacted zones are created around the wellbore area (as with explosives), there are no viscous fluids involved, there is no oxidation, and no specialty rig operations are required.

Therefore, disclosed is an apparatus for spatially orienting a subterranean pressure pulse in a hydrocarbon-bearing formation. The apparatus includes an injection body with a fixed shape, where the injection body is operable to hold an exothermic reaction component prior to triggering an exothermic reaction of the exothermic reaction component, and where the injection body maintains the fixed shape during and after triggering of the exothermic reaction component; a chemical injection port, where the chemical injection port is operable to feed components of the exothermic reaction component to the injection body; and a reinforced plug, where the reinforced plug is operable to direct a pressure pulse generated by the exothermic reaction component within the injection body to a perforation to generate a spatially-oriented fracture, where spatial orientation of the spatially-oriented fracture is pre-determined.

In some embodiments, the injection body further comprises a liner with a slot. In other embodiments, the slot further comprises a rupture membrane, where the rupture membrane is operable to rupture upon triggering of the exothermic reaction component. Still in other embodiments, the injection body further comprises a rotational orientation port, where the rotational orientation port is adjustable about a 360° rotational angle to direct the pressure pulse. Still in other embodiments, the reinforced plug comprises a first reinforced plug and a second reinforced plug, where the first reinforced plug and the second reinforced plug are operable to direct a pressure pulse generated by the exothermic reaction component within the injection body to the perforation.

Still in some other embodiments, the first reinforced plug and second reinforced plug are threadingly attachable and detachable from the injection body. In some embodiments, the apparatus further comprises a centralizer. In other embodiments, the apparatus includes a low pressure rupture sleeve. Still in other embodiments, the chemical injection port further comprises at least two chemical injection conduits, the chemical injection conduits operable to allow only one way flow into the injection body. In yet other embodiments, the injection body comprises more than one perforation operable to direct the pressure pulse.

Further disclosed is a method of increasing a stimulated reservoir volume in a hydrocarbon-bearing formation, the method including the steps of: disposing a perforated pressure pulse spatially-orienting tool within the formation to direct a pressure pulse in a pre-determined direction; disposing in the perforated pressure pulse spatially-orienting tool an exothermic reaction component in an aqueous solution; triggering the exothermic reaction component to generate an exothermic reaction which produces a pressure pulse; and generating the pressure pulse, such that the pressure pulse is operable to create a fracture in the pre-determined direction.

In some embodiments of the method, the exothermic reaction component comprises an ammonium containing compound and a nitrite containing compound. Still in other embodiments of the method, the ammonium containing compound comprises $NH_4Cl$ and the nitrite containing compound comprises $NaNO_2$. In some embodiments, the triggering step further includes a step selected from the group consisting of: heating the exothermic reaction component to a temperature of the hydrocarbon-bearing formation; applying microwave radiation to the exothermic reaction component; and decreasing the pH of the exothermic reaction component. In other embodiments, the pressure pulse produces between 500 psi and 50,000 psi pressure.

Still in yet other embodiments, the pressure pulse creates auxiliary fractures in less than about 10 seconds. In some embodiments, the pressure pulse creates fracture in the pre-determined direction in less than about 5 seconds. Still in other embodiments, the step of generating the pressure pulse further comprises the step of generating a substantially planar fracture. In yet some other embodiments, the method further includes the step of rupturing a membrane. Still in other embodiments, the step of disposing a perforated pressure pulse spatially-orienting tool within the formation is controlled remotely from the surface. In yet other embodiments, the facture is substantially planar. Still in other embodiments, the method includes the step of rotating the perforated pressure pulse spatially-orienting tool within the formation to direct the spatial orientation of the fracture.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the scope as it can admit to other equally effective embodiments.

DETAILED DESCRIPTION

Figure 1A:
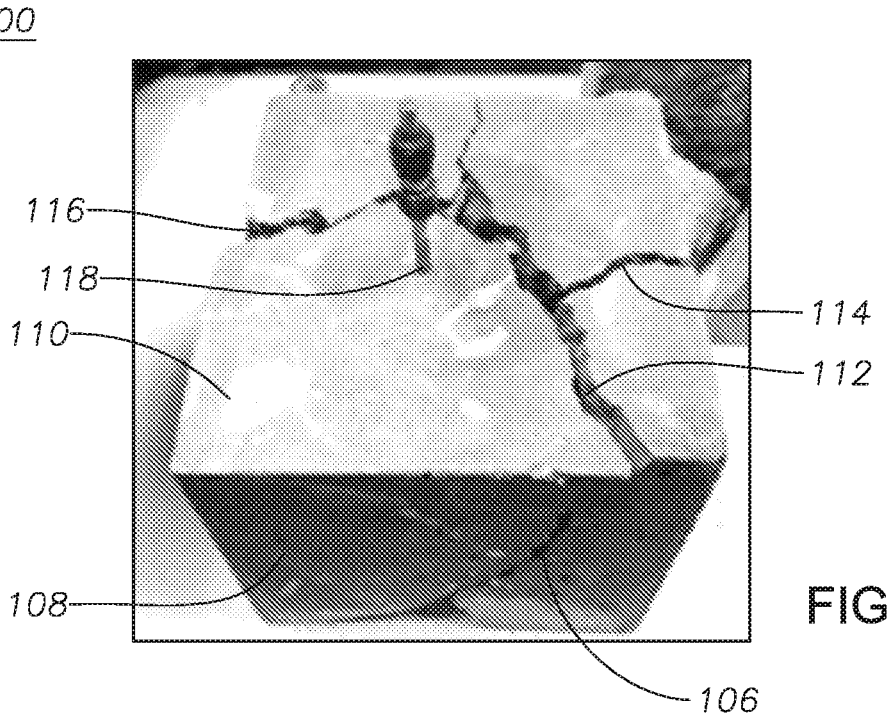
FIGS. 1A and 1B are pictorial representations showing the effect of non-spatially-oriented, chemically-pulsed fracturing on a cement sample.

While the disclosure will be described with several embodiments, it is understood that one of ordinary skill in the relevant art will appreciate that many examples, variations and alterations to the apparatus and methods described are within the scope and spirit of the disclosure. Accordingly, the embodiments of the disclosure described are set forth without any loss of generality, and without imposing limitations, on the claims.

Embodiments of an apparatus and method to increase the stimulated reservoir volume of a hydrocarbon-bearing formation are described as follows. The apparatus and method to increase a stimulated reservoir volume can be used in oil-containing formations, natural-gas-containing formations, water-containing formations, or any other formation. In at least one embodiment of the present disclosure, the method to increase a stimulated reservoir volume can be performed to create fractures and auxiliary fractures in any one of or any combination of sandstone, limestone, shale, and cement.

In one embodiment of the present disclosure, a method to increase a stimulated reservoir volume in a gas-containing formation is provided. The gas-containing formation can include a tight gas formation, an unconventional gas formation, and a shale gas formation. Formations include Indiana limestone, Beria sandstone, and shale. The stimulated reservoir volume is the volume surrounding a wellbore in a reservoir that has been fractured to increase well production. Stimulated reservoir volume is a concept useful to describe the volume of a fracture network. The method to increase a stimulated reservoir volume can be performed regardless of the reservoir pressure in the gas-containing formation. The method to increase a stimulated reservoir volume can be performed in a gas-containing formation having a reservoir pressure in a range of atmospheric pressure to about 680 atmospheres (atm) (10,000 pounds per square inch (psi)). A stimulated reservoir volume comprising a fracture network can be spatially and directionally oriented relative to a wellbore in certain embodiments of the disclosure.

In embodiments of the present disclosure, an exothermic reaction component is triggered to generate heat and pressure. When heat and pressure are generated quickly, a pressure pulse is created. A pressure pulse can be generated by triggering an exothermic reaction component in less than about 10 seconds, and in some embodiments less than about 1 second. An exothermic reaction of one or more exothermic reaction components can be triggered by an increase in temperature of the exothermic reaction component, optionally brought about by external heating from the surface or heating of the exothermic reaction component by heating from the hydrocarbon-bearing reservoir formation. The exothermic reaction of the exothermic reaction component can be triggered by a change in pH of the exothermic reaction component, such as by adding an acid or base.

In some embodiments, the exothermic reaction of the exothermic reaction component is triggered by microwave radiation being radiated toward the exothermic reaction component in situ. In some embodiments, a combination of heating the exothermic reaction component and radiating microwave radiation toward the exothermic reaction component can trigger the exothermic reaction in situ, or within the hydrocarbon-bearing formation.

In certain embodiments, the exothermic reaction component includes one or more redox reactants that exothermically react to produce heat and increase pressure. Exothermic reaction components include urea, sodium hypochlorite, ammonium containing compounds, and nitrite containing compounds. In at least one embodiment, the exothermic reaction component includes ammonium containing compounds. Ammonium containing compounds include ammonium chloride, ammonium bromide, ammonium nitrate, ammonium sulfate, ammonium carbonate, and ammonium hydroxide.

In at least one embodiment, the exothermic reaction component includes nitrite containing compounds. Nitrite containing compounds include sodium nitrite and potassium nitrite. In at least one embodiment, the exothermic reaction component includes both ammonium containing compounds and nitrite containing compounds. In at least one embodiment, the ammonium containing compound is ammonium chloride, $NH_4Cl$. In at least one embodiment, the nitrite containing compound is sodium nitrite, $NaNO_2$.

In at least one embodiment, the exothermic reaction component includes two redox reactants: $NH_4Cl$ and $NaNO_2$, which react according to the following equation:

$$NH_4Cl + NaNO_2 \xrightarrow{(H^+ \text{ and/or } \Delta H \text{ and/or microwaves})} N_2 + NaCl + 2H_2O + \text{Heat.} \qquad \text{Equation 1}$$

In a reaction of the exothermic reaction components according to the aforementioned equation, generated gas and heat can contribute to either one of or both of a pressure pulse to create fractures in a hydrocarbon-bearing formation and a reduction of the viscosity in a residual viscous material in the hydrocarbon-bearing formation.

The exothermic reaction component is triggered to react. In at least one embodiment, the exothermic reaction component is triggered within the fractures. In at least one embodiment, the exothermic reaction is triggered within the body of a pressure pulse spatially-orienting tool disposed within a wellbore of a hydrocarbon-bearing formation. In at least one embodiment of the present disclosure, an acid precursor triggers the exothermic reaction component to react by releasing hydrogen ions. In other embodiments, an increase in temperature of the exothermic reaction component, either by the well or by external heating or both, is used to trigger the exothermic reaction component. In some embodiments, microwave radiation applied to the exothermic reaction component is used to trigger the exothermic reaction. Any one of or any combination of heating, change in pH, and microwaves can be used to trigger the exothermic reaction component in situ.

The acid precursor is any acid that releases hydrogen ions to trigger the reaction of the exothermic reaction component. Acid precursors include triacetin (1,2,3-triacetoxypropane), methyl acetate, HCl, and acetic acid. In at least one embodiment, the acid precursor is triacetin. In at least one embodiment of the present disclosure, the acid precursor is acetic acid.

In at least one embodiment, the exothermic reaction component is triggered by heat. The wellbore temperature is reduced during a pre-pad injection or a pre-flush with brine and reaches a temperature less than about 48.9° C. (120° F.). When the wellbore temperature reaches a temperature greater than or equal to about 48.9° C. (120° F.), the reaction of the redox reactants is triggered. In at least one embodiment of the present disclosure, the reaction of the redox reactants is triggered by temperature in the absence of the acid precursor. In at least one embodiment of the present disclosure, the exothermic reaction component is triggered by heat when the exothermic reaction component is disposed within a pressure pulse spatially-orienting tool which itself is disposed within the fractures.

In at least one embodiment, the exothermic reaction component is triggered by pH. First, a base is added to the exothermic reaction component to adjust the pH to between 9 and 12. In at least one embodiment the base is potassium hydroxide. Following the injection of the exothermic reaction component into a pressure pulse spatially-orienting tool (described further as follows), an acid is injected to adjust the pH to less than about 6. When the pH is less than about 6, the reaction of the redox reactants is triggered. In at least one embodiment of the present disclosure, the exothermic reaction component is triggered by pH when the exothermic reaction component is disposed within a pressure pulse spatially-orienting tool, which itself is disposed proximate reservoir areas to be fractured, or is disposed within certain fractures.

Notably, the exothermic chemical reaction of the present disclosure is triggered by inert processes such as increase in temperature, in addition to or alternative to a decrease in pH, in addition to or alternative to application of microwaves. In other words, the reaction is triggered in the absence of or without a propellant, spark, or firing, which makes the exothermic reaction component much safer to contain and apply in a hydrocarbon environment. No detonation is taking place in situ. The exothermic reaction of appropriate exothermic reaction components creates a pressure pulse sufficient to fracture the formation, and a spatially-orienting tool will orient the created fractures. Embodiments of spatially-orienting tools described here contain two or more injection lines to allow injecting two or more different reactants in-situ separately. One advantage presented by the safety of the exothermic reaction component and the ability to inject the reactants separately is that multiple fracturing pulses can be created in one run downhole.

In at least one embodiment, the exothermic reaction component includes $NH_4Cl$ and $NaNO_2$. The acid precursor is acetic acid. The acetic acid is mixed with $NH_4Cl$ and is injected in parallel with the $NaNO_2$, using different sides of dual-string coiled tubing.

In certain embodiments of the present disclosure, the exothermic reaction component is mixed to achieve a pre-selected solution pH. The pre-selected solution pH is in a range of about 6 to about 9.5, alternately about 6.5 to about 9. In at least one embodiment, the pre-selected solution pH is 6.5. The exothermic reaction component reacts and upon reaction generates a pressure pulse that creates fractures, optionally including auxiliary fractures and a fracture network. In some embodiments of the present disclosure, the apparatus and methods can be used in combination with conventional fracturing fluids.

For example, fracturing fluid is used in a primary operation to create primary fractures. The auxiliary fractures created by the apparatus and methods of the present disclosure extend from the primary fractures caused by the fracturing fluid to create a fracture network. The fracture network increases the stimulated reservoir volume. In some embodiments, the injection of the hydraulic fracturing fluid, including any one of or any combination of a viscous fluid component, a proppant component, an overflush component, and an exothermic reaction component, does not generate foam or introduce foam into the hydraulic formation including the hydraulic fractures.

In at least one embodiment, the exothermic reaction component reacts when the exothermic reaction component reaches the wellbore temperature. The wellbore temperature is between about 37.8° C. (100° F.) and about 121° C. (250° F.), alternately between about 48.9° C. (120° F.) and about 121° C. (250° F.), alternately between about 48.9° C. (120° F.) and about 110° C. (230° F.), alternately between about 60° C. (140° F.) and about 98.9° C. (210° F.), alternately about 71.1° C. (160° F.) and about 87.8° C. (190° F.). In at least one embodiment, the wellbore temperature is about 93.3° C. (200° F.). In at least one embodiment, the wellbore temperature at which the exothermic reaction component reacts is affected by the pre-selected solution pH and an initial pressure. The initial pressure is the pressure of the exothermic reaction component just prior to the reaction of the exothermic reaction component. Increased initial pressure can increase the wellbore temperature that triggers the reaction of the exothermic reaction component. Increased pre-selected solution pH can also increase the wellbore temperature that triggers the reaction of the exothermic reaction component.

When the exothermic reaction component reacts, the reaction generates a pressure pulse and heat. The pressure pulse is generated within milliseconds from the start of the reaction. The pressure pulse is at a pressure between about 34 atm to about 3402 atm (about 500 psi and about 50,000 psi), alternately between about 34 atm and about 1361 atm (500 psi and about 20,000 psi), alternately between about 34 atm and about 1021 atm (about 500 psi and about 15,000 psi), alternately between about 68 atm and about 680 atm (about 1,000 psi and about 10,000 psi), alternately between about 68 atm and about 340 atm (1,000 psi and about 5,000 psi), and alternately between about 340 atm and about 680 atm (about 5,000 psi and about 10,000 psi).

In certain embodiments, the pressure pulse creates auxiliary fractures. The auxiliary fractures extend from the point of reaction in a pre-determined and pre-selected direction without causing damage to the wellbore or the fractures created. The pressure pulse creates the auxiliary fractures regardless of the reservoir pressure. The pressure of the pressure pulse is affected by the initial reservoir pressure, the concentration of the exothermic reaction component, and the solution volume. In addition to the pressure pulse, the reaction of the exothermic reaction component releases heat. The heat released by the reaction causes a sharp increase in the temperature of the formation, which causes thermal fracturing. Thus, the heat released by the exothermic reaction component contributes to the creation of the auxiliary fractures. The exothermic reaction component allows for a high degree of customization to meet the demands of the formation and fracturing conditions.

The method of the present disclosure can be adjusted to meet the needs of the fracturing operation. In one embodiment, the fracturing fluid includes an exothermic reaction component that reacts to both create auxiliary fractures and to cleanup residual viscous material from the fracturing fluid. In one embodiment of the present disclosure, the fracturing fluid includes an exothermic reaction component that reacts to only create auxiliary fractures. In one embodiment, the fracturing fluid includes an exothermic reaction component that reacts to only cleanup residual viscous material by reducing viscosity of a residual material with generated heat.

Non-Spatially-Oriented Chemically-Induced Pressure Pulses

Figure 1B:
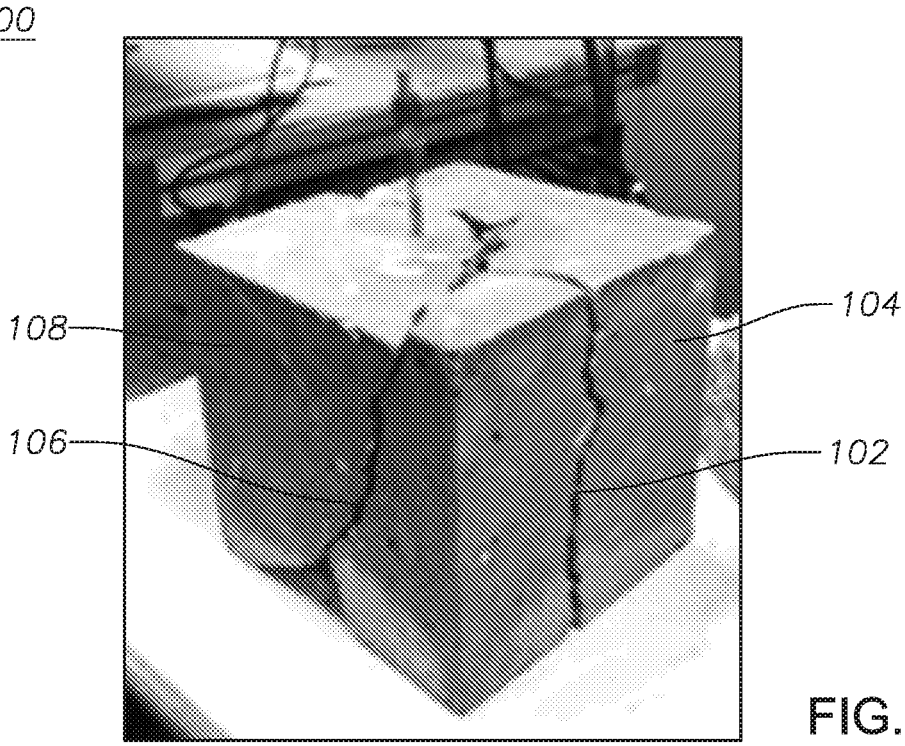

Referring now to FIGS. 1A and 1B, pictorial representations are provided showing the effect of non-spatially-oriented, chemically-pulsed fracturing on a cement sample. Cement sample 100 is a 20.32 centimeter (cm) (8 inch (in)) by 20.32 cm (8 in) by 20.32 cm (8 in) cube or block. FIGS. 1A and 1B show fracturing that results from the pressure pulse of an exothermic reaction component without spatially orienting the direction of the pressure and heat generated by the exothermic reaction. The exothermic reaction was triggered with the exothermic reaction component located in an open hole drilled in the geometric center of the block. As a result, a substantially vertical fracture 102 was generated through the cement sample 100 to a side face 104, and a substantially vertical fracture 106 was generated through the cement sample 100 to a side face 108.

Portland cement was used in the examples presented throughout the disclosure, and the cement was casted from mixing water and cement with a weight ratio of about 31:100, respectively. The physical and mechanical properties of the rock samples were porosity of about 24%, bulk density of about 2.01 gm/cm$^3$, Young's modulus of about $1.92\times10^6$ psi, Poisson's ratio of about 0.05, uniaxial compressive strength of about 3,147 psi, cohesive strength of about 1,317 psi, and an internal friction angle of about 10°. The breakdown pressure for cement sample 100 shown in FIGS. 1A and 1B was 4,098 psi.

There was no external pressure or compression applied during the experiment shown in FIGS. 1A and 1B. 86 ml of solution (containing 3 molar sodium nitrite and 3 molar ammonium chloride) were injected in cement sample 100 to create the pressure pulse. The pH of the solution was about 6.5. The reaction was triggered by heating cement sample 100 to about 93.3° C. (about 200° F.). Cement sample 100 was placed in a 93.3° C. (200° F.) oven for heating. A vertical openhole was casted in the geometric center of the block. The hole was 7.62 cm (3 in) long and 3.81 cm (1.5 in) in diameter. Chemicals were injected from one inlet 118 as shown in FIG. 1A. Inlet 118 and an outlet (not shown) were closed with valves.

On upper face 110, a substantially longitudinal fracture 112 was generated through cement sample 100 to upper face 110, and a substantially transverse fracture 114 and a substantially transverse fracture 116 were generated through cement sample 100 to upper face 110. The fractures shown in FIGS. 1A and 1B are considered to be random or non-ordered, as the pressure pulse and heat from the exothermic reaction of the exothermic reaction component were not spatially directed or oriented. In another experiment, non-spatially-oriented, chemically-pulsed fracturing was carried out on a 20.32 (cm) (8 in) by 20.32 cm (8 in) by 20.32 cm (8 in) cement sample under 340 atm (5,000 psi) compression from all sides (also referred to as biaxial confinement stress). Fracturing results were achieved similar to those shown in FIGS. 1A and 1B.

Figure 2A:
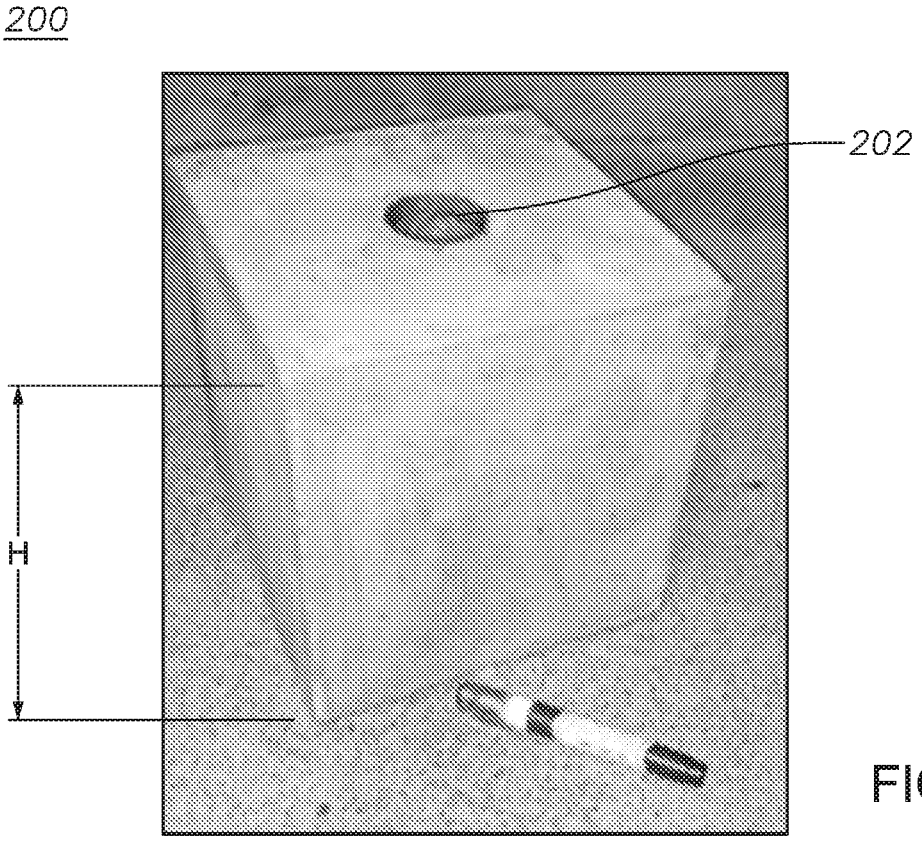
FIG. 2A is a pictorial representation showing a cement sample before the effect of non-spatially-oriented, chemically-pulsed fracturing.

Referring now to FIG. 2A, a pictorial representation is provided showing a cement sample before the effect of non-spatially-oriented, chemically-pulsed fracturing. Cement sample 200 is a 20.32 (cm) (8 in) by 20.32 cm (8 in) by 20.32 cm (8 in) cube or block and has a 3.81 cm (1.5 in) diameter vertical open hole 202 drilled in the geometric center of the cube through the entire height of the cube H. Cement sample 200 has physical properties substantially the same as those as described with regard to cement sample 100 in FIGS. 1A and 1B. To each side of cement sample 200 was applied 272 atm (4,000 psi) compression. The exothermic reaction component contained 3 M sodium nitrite and 3 M ammonium chloride.

Figure 2B:
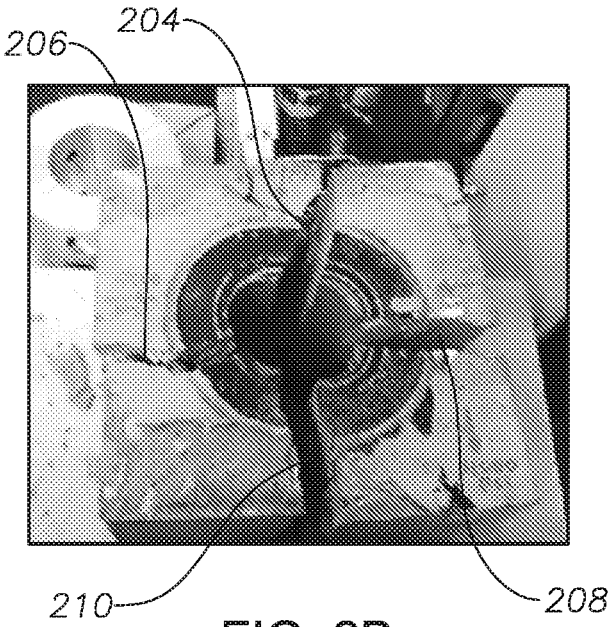
FIGS. 2B and 2C are pictorial representations showing a cement sample after the effect of non-spatially-oriented, chemically-pulsed fracturing.
Figure 2C:
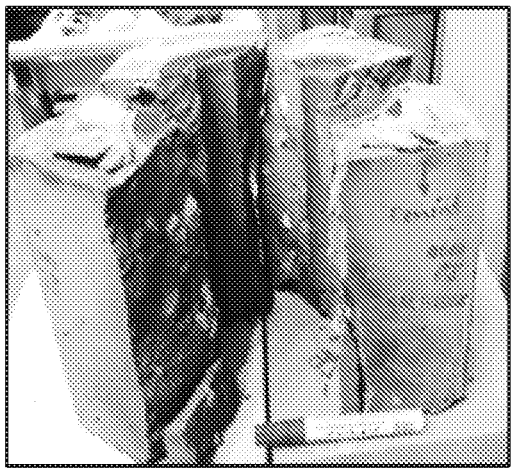

Referring now to FIGS. 2B and 2C, pictorial representations are provided showing the cement sample 200 after the effect of non-spatially-oriented, chemically-pulsed fracturing. The confined condition test was simulated in the center of the 20.32 (cm) (8 in) by 20.32 cm (8 in) by 20.32 cm (8 in) cement sample 200. Cement sample 200 was placed in a biaxial loading frame where two horizontal stresses of a given stress were applied while the vertical stress was controlled by mechanical tightening of the base and top plates. Then, the exothermic reaction component was injected in the rock sample at atmospheric pressure and room temperature at a rate of 15 cubic centimeters/minute (cc/min). The rock sample was then heated for 2 to 3 hours until the reaction took place and fractures were created.

Figure 3:
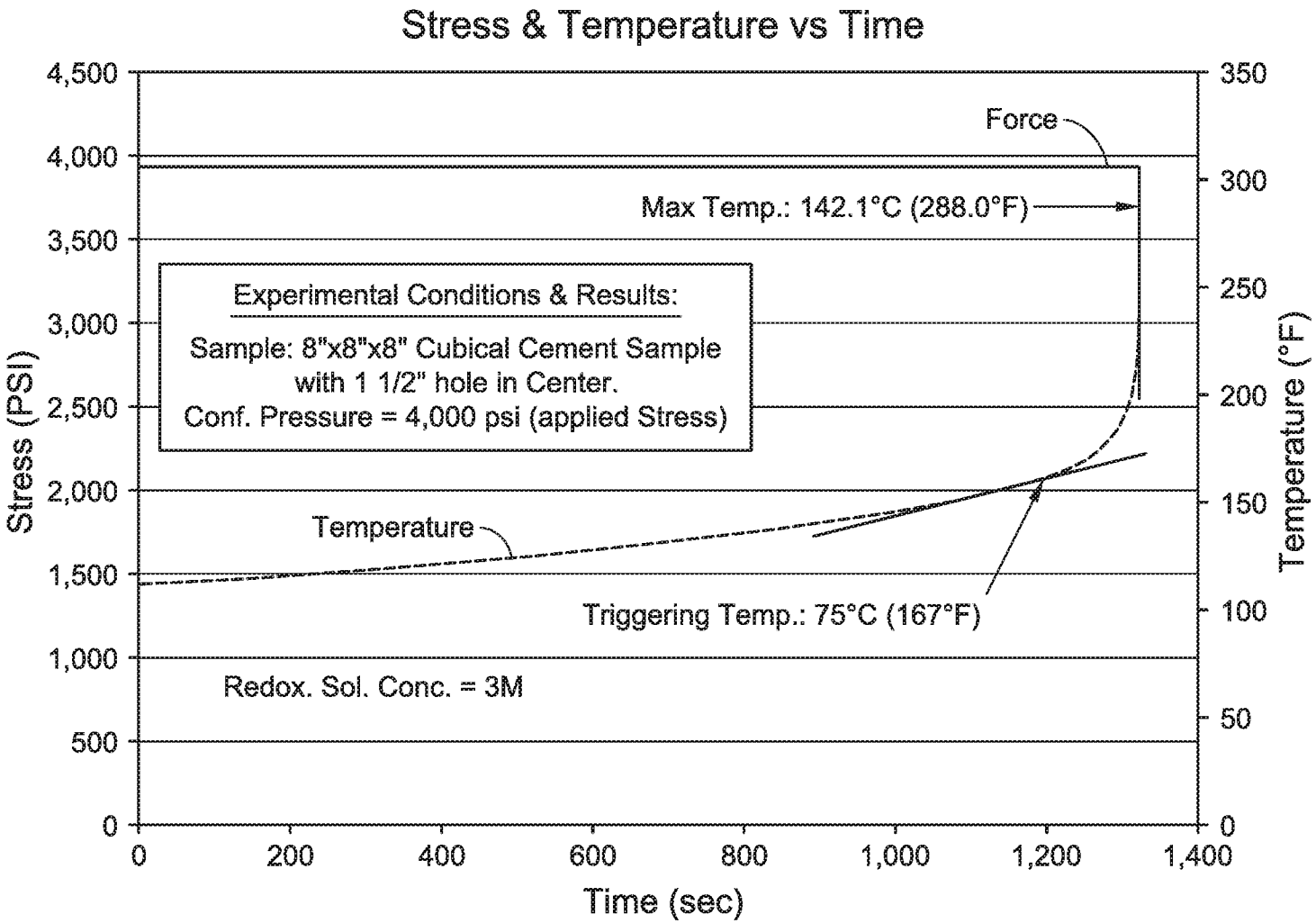
FIG. 3 is a graph showing the experimental conditions and the effect of the pressure pulse in the experiment generating the fractures shown in FIGS. 2B and 2C.

The reaction was triggered at 75° C. (167° F.). The applied horizontal stress was 272 atm (4,000 psi) in both directions, as shown in FIG. 3. Four vertical fractures 204, 206, 208, and 210 were created with respect to the vertical open hole 202. The fracture geometry shows that the fractures were vertical with respect to the vertical openhole wellbore. The fracture geometry indicates that two sets of fractures propagated from the vertical openhole wellbore to the end of the cement sample 200, indicating that the pressure generated by the exothermic reaction component was greater than 544 atmospheres (atm) (8,000 psi). Each created planar fracture propagated in the direction of one of the horizontal stresses, and perpendicular to the direction of the other, as the applied stress was equal in both horizontal directions.

Referring now to FIG. 3, a graph is provided showing the experimental conditions and the effect of the pressure pulse in the experiment generating the fractures shown in FIGS. 2B and 2C. The exothermic reaction component comprising 3M ammonium chloride and 3M sodium nitrite was heated within cement sample 200, and the exothermic reaction was triggered at 75° C. (167° F.). Once triggered, the reaction quickly generated pressure, heat, and a pressure pulse to fracture cement sample 200 as shown in FIGS. 2A and 2B. Confined tests confirm that the initial reservoir pressure does not diminish the pulse pressure and the ability of the pulse pressure to generate fractures, fracture networks, and auxiliary fractures.

Spatially-Oriented, Chemically-Induced Pressure Pulses

Figure 4A:
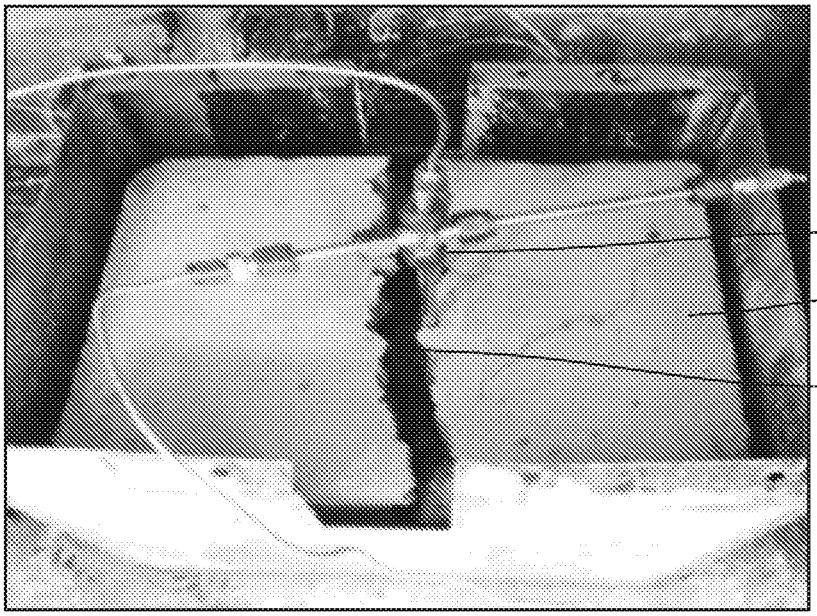
FIGS. 4A and 4B are pictorial representations showing a single, substantially vertical, and substantially longitudinal fracture generated by a spatially-oriented, chemically-induced pressure pulse in a cement block without applied external compression.
Figure 4B:
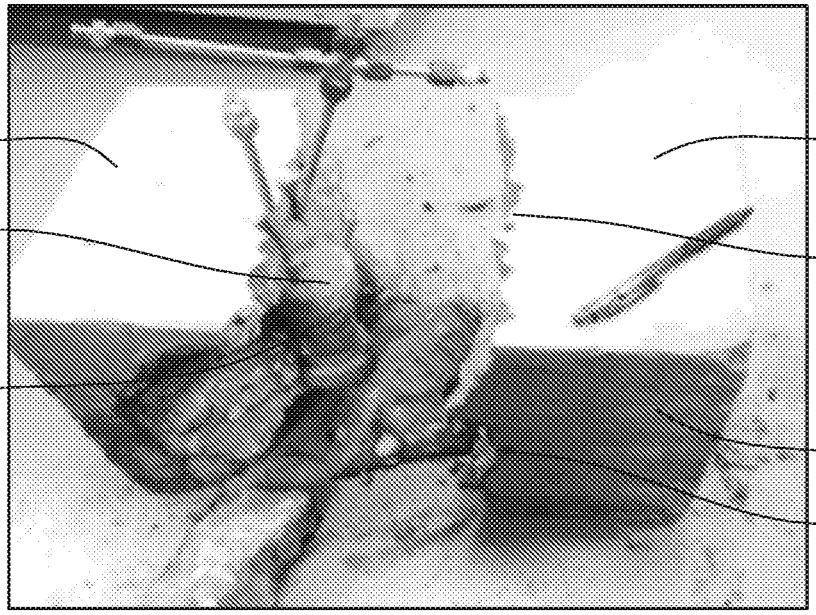

Referring now to FIGS. 4A and 4B, pictorial representations are provided showing a single, substantially vertical, and substantially longitudinal fracture generated by a spatially-oriented, chemically-induced pressure pulse. Cement sample 400 is a cement cube or block with dimensions 25.4 (cm) (10 in) by 25.4 cm (10 in) by 25.4 cm (10 in). A perforated pressure pulse spatially-orienting tool 402 is shown embedded within cement sample 400 at the center of the block. Perforated pressure pulse spatially-orienting tool 402 was a perforated tool with two holes, and was used to contain and direct the exothermic reaction of the exothermic reaction component and tool 402 spatially oriented the pressure pulse. Pressure pulse spatially-orienting tools, such as perforated pressure pulse spatially-orienting tool 402, are described further as follows with regards to FIGS. 7-12.

FIGS. 4A and 4B show that because perforated pressure pulse spatially-orienting tool 402 was used to direct the pressure pulse generated by the exothermic reaction of the exothermic reaction component, only one substantially longitudinal fracture 404 is visible in an upper face 406 of cement sample 400. As can be seen, there are no transverse fractures proceeding perpendicularly to substantially longitudinal fracture 404 in upper face 406 of cement sample 400. Similarly, in side face 408 only one substantially vertical fracture 410 is visible. There are no horizontal fractures proceeding perpendicularly to substantially vertical fracture 410. Cement sample 400 is shown to be broken into substantially neat halves 412, 414 with the use of perforated pressure pulse spatially-orienting tool 402.

Figure 5:
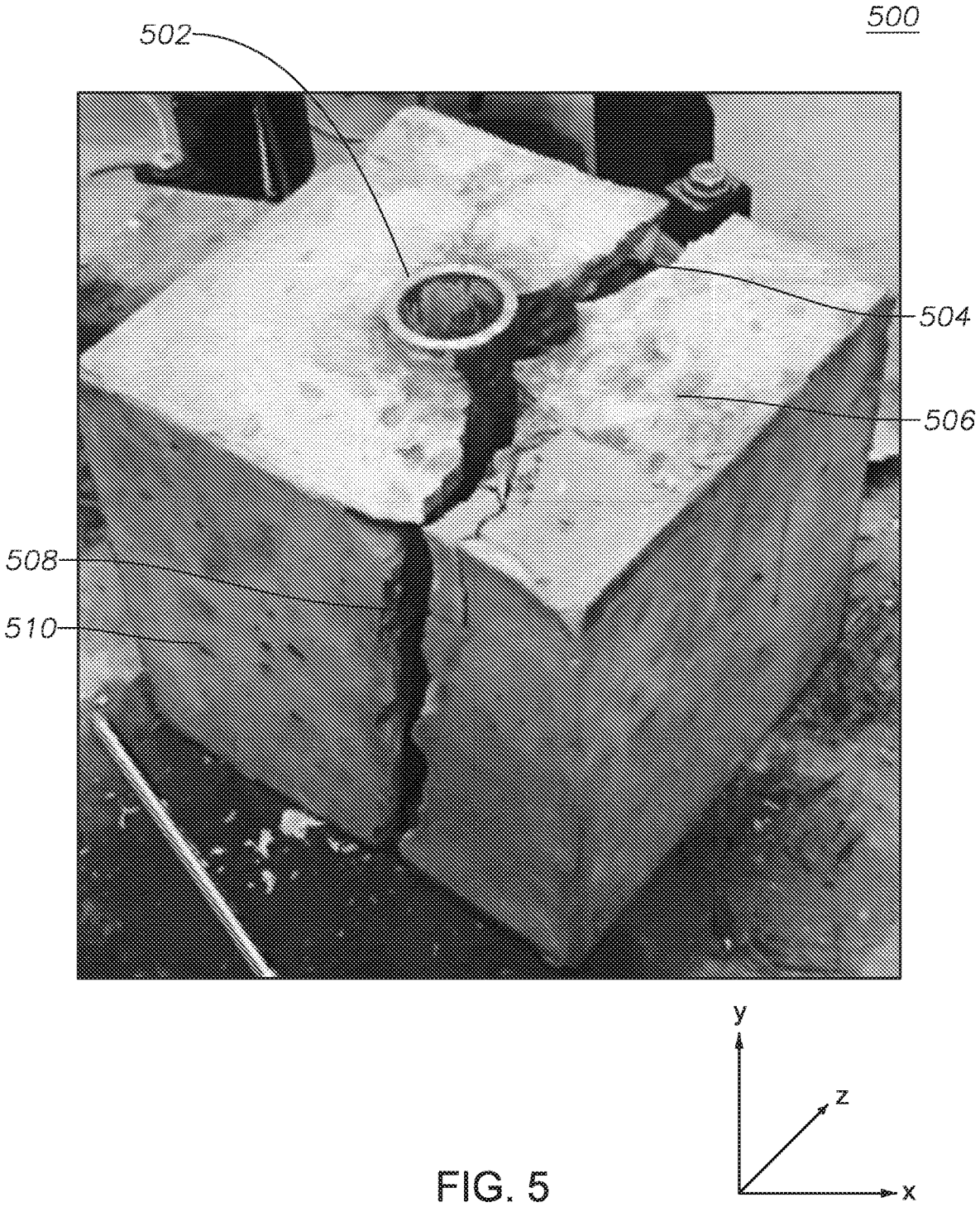
FIG. 5 is a pictorial representation showing a single, substantially vertical, and substantially longitudinal fracture generated by a spatially-oriented, chemically-induced pressure pulse while the cement block was under 340 atm (5,000 psi) biaxial compression.

FIGS. 4A and 4B represent the same experiment and same cement sample 400 with different views. FIG. 4B shows the tool used (shown in FIG. 7) within the cement sample 400. In the experiment of FIGS. 4A and 4B, there was no external stress or compression applied to cement sample 400. In FIG. 5, cement sample 500 was placed in a biaxial system and stress was applied. The pressure pulse orienting tools used are in principle substantially similar between FIGS. 4 and 5.

The cement type and physical properties are as earlier described with regards to FIGS. 1A and 1B. Perforated pressure pulse spatially-orienting tool 402 was positioned in the geometric center of the cement sample 400. Perforated pressure pulse spatially-orienting tool 402 was 12.7 cm (5 in) in height and 4.572 (1.8 in) in diameter. Tool 402 had two oppositely placed perforations, one of which (perforation 403) is shown in FIG. 4B in the walls of tool 402. As can be seen, the perforations, including perforation 403, align with substantially longitudinal fracture 404. The solution concentration was 3 molar sodium nitrite and 3 molar ammonium chloride, with 6.5 pH. The reaction was triggered by heating cement sample 400 to about 93.3° C. (about 200° F.).

Referring now to FIG. 5, a pictorial representation is provided showing a single, substantially vertical, and substantially longitudinal fracture generated by a spatially-oriented, chemically-induced pressure pulse while the cement block is under 340 atm (5,000 psi) compression. Cement sample 500 was fractured using a perforated pressure pulse spatially-orienting tool 502 (placed in the geometric center of the cement sample 500), which is pictured in FIG. 8 and described further as follows. Substantially longitudinal fracture 504 is seen in upper face 506, and substantially vertical fracture 508 is seen in side face 510. Longitudinal fracture 504 and vertical fracture 508 together form an oriented pulse fracture that is substantially square in the cross section through the cement sample 500. In other words, a substantially planar fracture is created in the Y, Z plane.

The oriented pulse fracture extends in both directions along the Y and Z axes outwardly from perforated pressure pulse spatially-orienting tool 502 forming a substantial plane along the Y and Z axes. There are no substantial fractures proceeding outwardly from perforated pressure pulse spatially-orienting tool 502 along the X axis perpendicular to the plane formed by the Y and Z axes. The physical properties of cement sample 500 are substantially the same as those described for cement sample 100 in FIGS. 1A and 1B. The solution concentration was 3 molar sodium nitrite and 3 molar ammonium chloride, with 6.5 pH. The reaction was triggered by heating cement sample 400 to about 93.3° C. (about 200° F.).

Figure 6A:
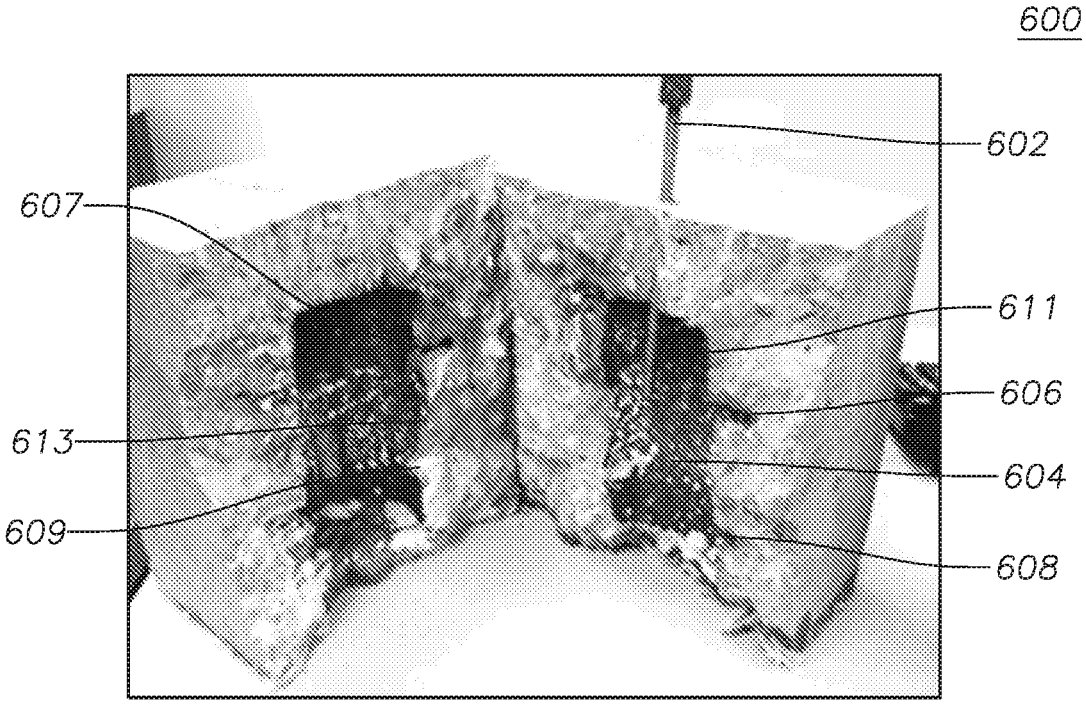
FIGS. 6A and 6B are pictorial representations showing a longitudinal and vertical fracture generated by a spatially-oriented, chemically-induced pressure pulse using directional niches.
Figure 6B:
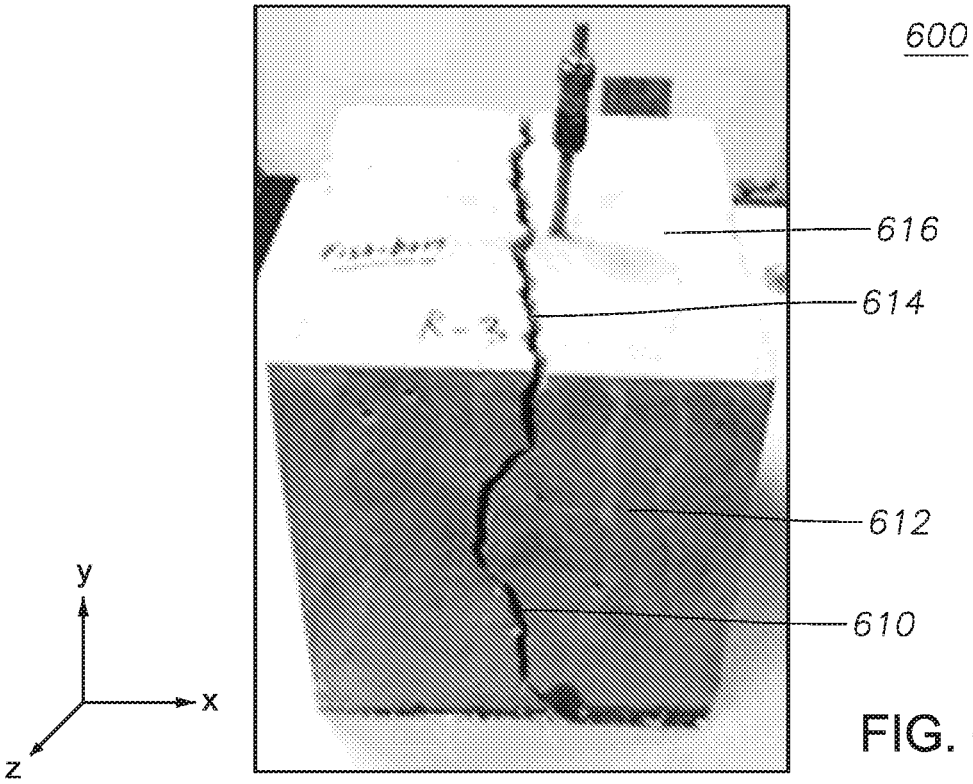

FIGS. 6A and 6B are pictorial representations showing a longitudinal and vertical fracture generated by a spatially-oriented, chemically-induced pressure pulse using directional niches. Cement sample 600 was fractured using injection tool 602 to place an exothermic reaction component in cavity 604 within cement sample 600. Directional niches 606, 607, 608, 609 were drilled on sidewalls 611, 613 of the cavity 604 of the cement sample 600. Directional niches 606, 607, 608, 609 were formed prior to the experiment during casting of the cement sample 600. The experiment exemplifies creating oriented fractures in real open hole oil wells using directional niches. The exothermic reaction component was placed in cavity 604 without any pressure pulse spatially-orienting tool; however, in other embodiments a pressure pulse spatially-orienting tool could be used in conjunction with, before, or after directional niches.

As can be seen in FIG. 6B, a substantially vertical fracture 610 was created in side face 612 of cement sample 600, and a substantially longitudinal fracture 614 was created in upper face 616 of cement sample 600. Substantially vertical fracture 610 and substantially longitudinal fracture 614 together form an oriented pulse fracture that is substantially square in the cross section through the cement sample 600.

The oriented pulse fracture extends in both directions along the Y and Z axes outwardly from the niche-directed, spatially-oriented pressure pulse proceeding outwardly from cavity 604, forming a substantial plane along the Y and Z axes. There are no substantial fractures proceeding outwardly from niche-directed spatially-oriented pressure pulse along the X axis perpendicular to the plane formed by the Y and Z axes. The physical properties of cement sample 600 are substantially the same as those described for cement sample 100 in FIGS. 1A and 1B. The solution concentration was 3 molar sodium nitrite and 3 molar ammonium chloride, with 6.5 pH. The reaction was triggered by heating cement sample 400 to about 93.3° C. (about 200° F.).

Pressure Pulse Spatially-Orienting Tools

Figure 7:
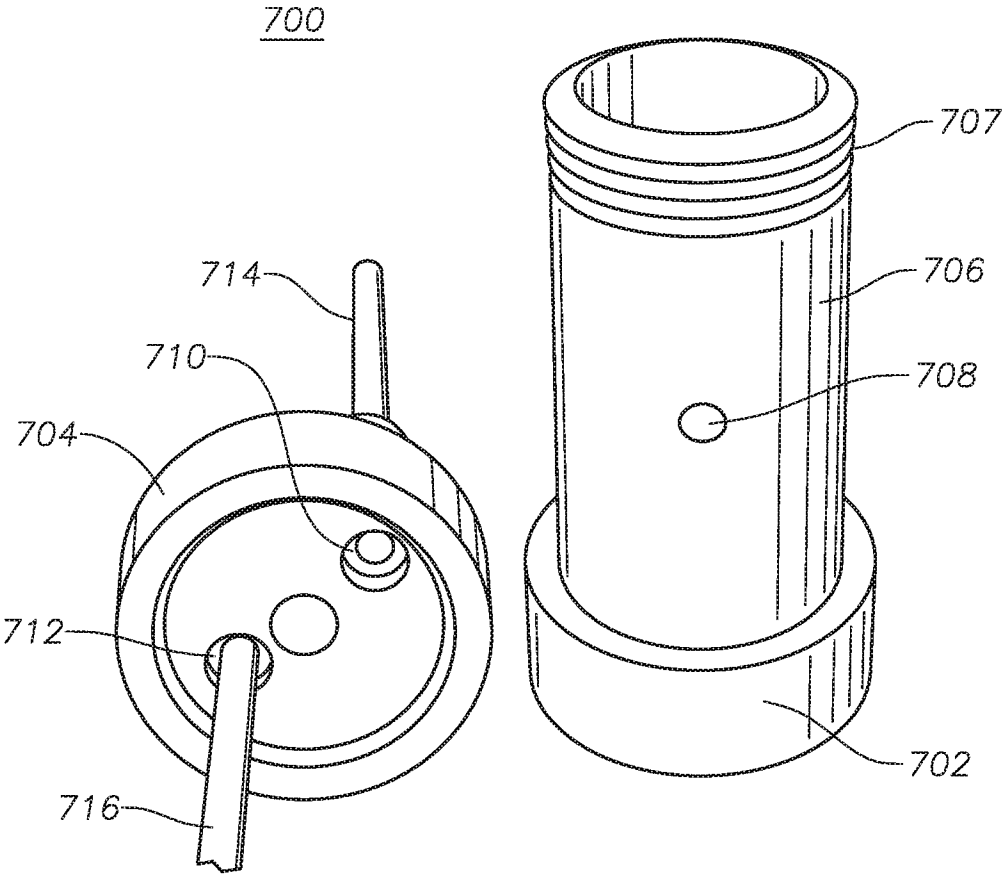
FIG. 7 is a schematic representation of one embodiment of a tool used to spatially orient a chemically-induced pressure pulse.

FIG. 7 is a schematic representation of one embodiment of a tool used to spatially-orient a chemically-induced pressure pulse. Perforated pressure pulse spatially-orienting tool 700 includes a lower reinforced plug 702, an upper reinforced plug 704, and an injection body 706. In the embodiment shown, lower reinforced plug 702 and upper reinforced plug 704 twist or screw onto injection body 706 by threads 707. Reinforced plugs 702, 704 and injection body 706 are designed to remain a single unit under an internal pressure pulse of up to about 2,041 atm (30,000 psi) generated inside injection body 706 by an exothermic reaction of an exothermic reaction component. In this way, the pressure pulse and any heat generated by an exothermic reaction will be forced through one or more perforations 708 positioned on injection body 706.

Upper reinforced plug 704 includes openings 710, 712 with chemical injection conduits 714, 716, respectively. When upper reinforced plug 704 is attached to injection body 706, the chemicals that make up the exothermic reaction component can be added to the injection body by chemical injection conduits 714, 716. In the embodiment shown, perforated pressure pulse spatially-orienting tool 700 is made substantially of steel; however, in other embodiments other materials capable of withstanding pressures up to about 2,041 atm (30,000 psi) can be used.

Additionally, perforated pressure pulse spatially-orienting tool 700 is substantially cylindrical and substantially circular in the cross section. In other embodiments, a perforated pressure pulse spatially-orienting tool could be other shapes, such as a substantially rectangular prism, substantially square in the cross section. In other embodiments, reinforced plugs can be welded to or integrally molded with the injection body, rather than screwing, twisting, or threading to attach. In other embodiments, more or fewer perforations can be disposed in any suitable arrangement on a spatially-orienting tool to generate fractures in desired, pre-determined planes or configurations in situ.

Figure 8:
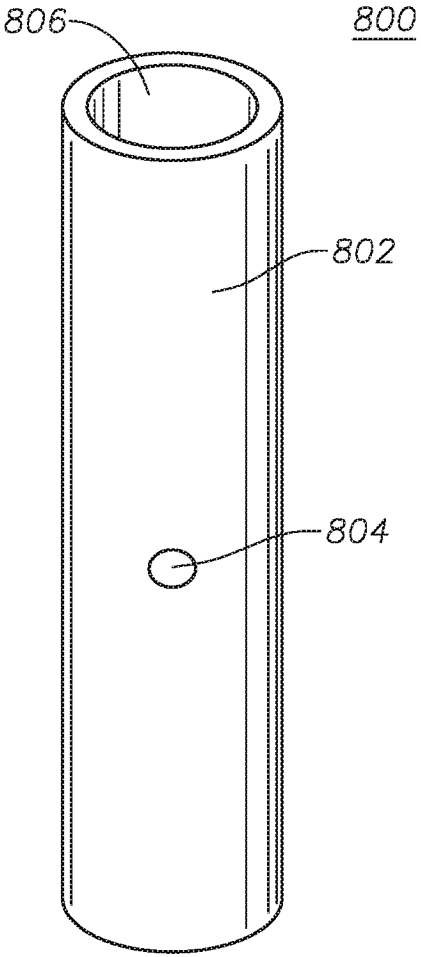
FIG. 8 is a schematic representation of one embodiment of a tool used to spatially orient a chemically-induced pressure pulse (exemplified use in FIG. 5).

FIG. 8 is a pictorial representation of one embodiment of a tool used to spatially-orient a chemically-induced pressure pulse. Perforated pressure pulse spatially-orienting tool 800 includes an injection body 802, a perforation 804, and an injection inlet 806. A second perforation (not shown) is disposed on injection body 802 opposite to and parallel with perforation 804. Perforated pressure pulse spatially-orienting tool 800 was used in the experiment in the embodiment of FIG. 5. Injection inlet 806 was capped by a component of the biaxial compression system (not shown). Injection body 802 is designed to remain a single unit under an internal pressure pulse of up to about 2,041 atm (30,000 psi) generated inside injection body 802 by an exothermic reaction of an exothermic reaction component. In this way, the pressure pulse and any heat generated by an exothermic reaction will be forced through perforation 804 positioned on injection body 802.

Figure 9:
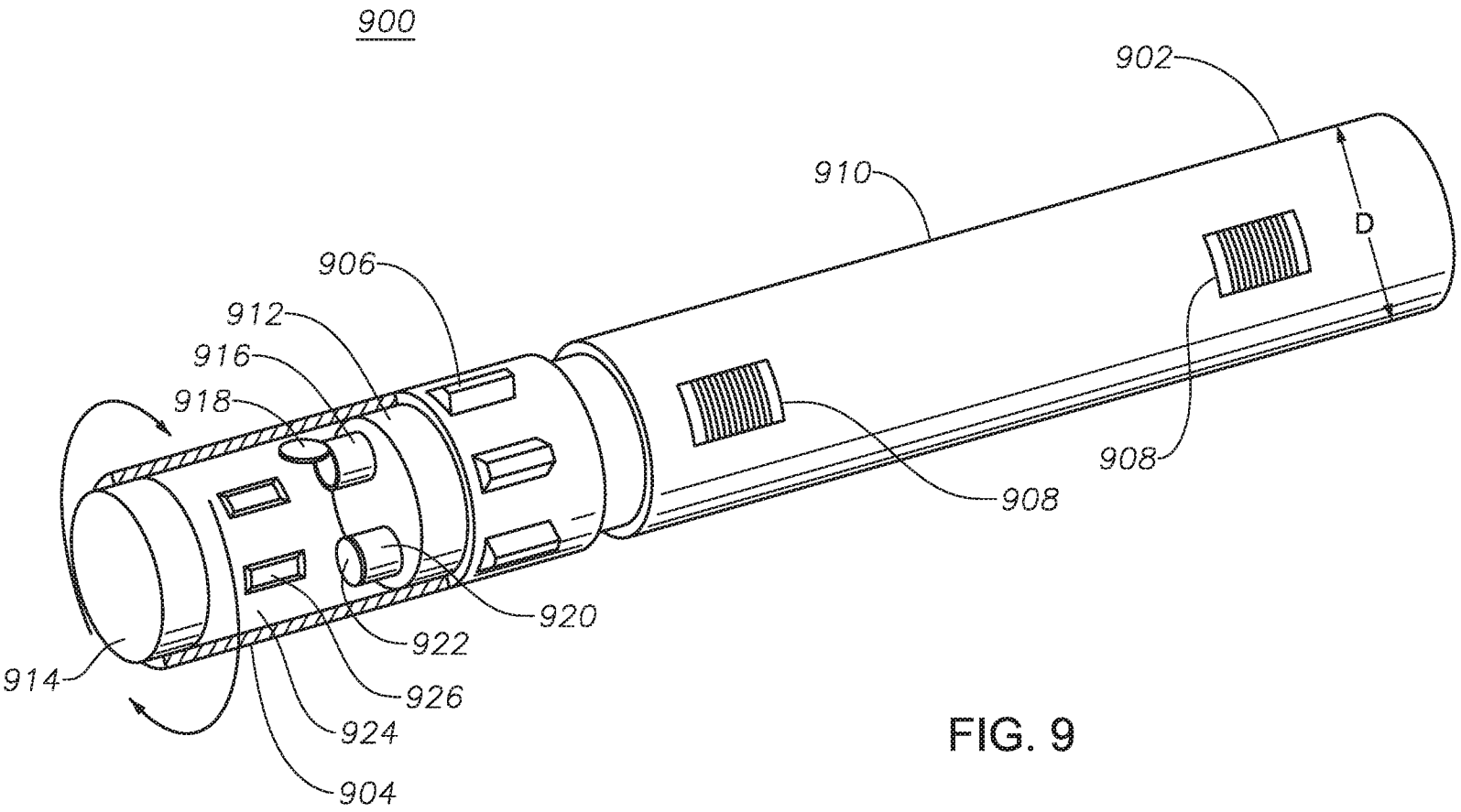
FIG. 9 is a schematic of a tool for spatially orienting a chemically-induced pressure pulse in an open hole wellbore (wellbore without casing) in a hydrocarbon-bearing formation.

In principle, the tools in FIGS. 8 and 9 are similar; however, different tool configurations can be used in open-hole testing, biaxial compression system testing, in open-hole operations, and in cased-hole operations. Perforated pressure pulse spatially-orienting tool 800 was used in the experiment in the embodiment of FIG. 5, and injection inlet 806 was closed during the experiment with biaxial compression machine accessories (not shown). In other embodiments, more or fewer perforations can be disposed on an injection body. For instance, on a substantially cylindrical injection body, if fracturing were desired in the fashion of substantially perpendicular intersecting vertical planes, four perforations could be disposed around a substantially cylindrical injection body at 90° orientations relative to one another. More than one set of four perforations could be disposed along the injection length with the perforations aligned to create fractures aligned with substantially perpendicular intersecting planes.

The chemicals that make up the exothermic reaction component can be added to injection body 802 by injection inlet 806. In the embodiment shown, the perforated pressure pulse spatially-orienting tool 800 is made substantially of steel; however, in other embodiments other materials capable of withstanding pressures up to about 2,041 atm (30,000 psi) can be used. Additionally, perforated pressure pulse spatially-orienting tool 800 is substantially cylindrical and substantially circular in the cross section. In other embodiments, a perforated pressure pulse spatially-orienting tool could be other shapes, such as a substantially rectangular prism, substantially square in the cross section. In other embodiments, reinforced plugs can be welded to or integrally molded with the injection body, rather than screwing or twisting to attach.

FIG. 9 is a schematic of a tool for spatially orienting a chemically-induced pressure pulse in an open hole (without casing) wellbore in a hydrocarbon-bearing formation. Open hole pressure pulse spatially-orienting tool 900 includes a tool body 902, a tool head 904, and a centralizer 906, which operably couples tool body 902 and tool head 904. In the embodiment shown, the diameter D of tool body 902 and tool head 904 are the same, and D is about 5.08 cm (about 2 in). In other embodiments, the diameters of a tool head and a tool body can be different. In some embodiments, the diameter of a tool head and tool body is about 10.16 cm (4 in). Still in other embodiments, the diameter of either or both the tool head and tool body is sized so as to accommodate the wellbore into which the tool will be disposed for generating fractures.

Tool body 902 includes latching 908, which allows for secure placement of the tool body into the wellbore, and includes rotational assembly 910. Rotational assembly 910 allows for 360° rotation of tool head 904 relative to tool body 902, as shown by the rotational arrows in FIG. 9. Centralizer 906 is operably coupled to rotational assembly 910, and centralizer 906 centralizes open hole pressure pulse spatially-orienting tool 900 within a wellbore. Latching 908 ensures that tool body 902 "latches" or is disposed in the desired specific location in a wellbore, and latching 908 ensures tool body 902 will not slip. Tool body 902 can also be inserted into a steel casing, and both tool body 902 and casing have smooth surfaces, but when latching 908 is used, tool body 902 will slide into the casing and latching 908 will lock into grooves in the casing.

In some embodiments, the rotational assembly 910 is automated and is controlled by either or both of wireless and wireless means from the surface. In this way, an operator can rotate tool head 904 to direct a pressure pulse. One function of centralizer 906 is to ensure tool body 902 is in the geometric center of a wellbore so it is aligned with the formation for better controlled spatial orientation of a pressure pulse.

Tool head 904 includes reinforced plug 912, reinforced plug 914, chemical injection conduit 916 with one way valve 918, chemical injection conduit 920 with one way valve 922, and pre-slotted liner 924 with rupture membranes 926. Chemical injection conduits 916, 920 allow for the injection of the exothermic reaction component, either in a single step or in multiple steps, into tool head 904. Before the exothermic reaction of the exothermic reaction component is initiated, the exothermic reaction component is disposed within pre-slotted liner 924.

When the exothermic reaction is triggered, rupture membranes 926 break or rupture allowing the pressure pulse and heat generated by the exothermic reaction to proceed outwardly through pre-slotted liner 924. High pressure pulses are generated by the exothermic reaction component, as discussed previously, and thus reinforced plugs 912, 914 are designed to remain integral with tool head 904 at pressures up to about 2041 atm (30,000 psi). Reinforced plugs 912, 914 are similar to reinforced plugs 702, 704, shown in FIG. 7. One example of rupture membranes, such as rupture membranes 926, would be rupture disks. The size, location, orientation, number, material, and pressure rating of rupture membranes is deigned based on the wellbore and reservoir parameters, and by understanding these parameters, the rupture membranes will be suitable to spatially orient a pressure pulse.

The chemical components of the exothermic reaction component in the embodiment of FIG. 9 are injected separately into tool head 904 before being triggered. One way valves 918, 922 prevent back pressure from flowing back to coiled tubing in the wellbore, which would result in kicks. In an open hole wellbore, open hole pressure pulse spatially-orienting tool 900 allows the generated pressure pulse to penetrate the hydrocarbon-bearing formation and orient the energy in a desired direction. Tool head 904 is rotatable in any direction 360° around by rotational assembly 910. While the pressure pulse spatially-orienting tools of FIGS. 7-9 are different and show different levels of mechanical detail, in principle they all direct a pressure pulse in substantially the same way.

Figure 10:
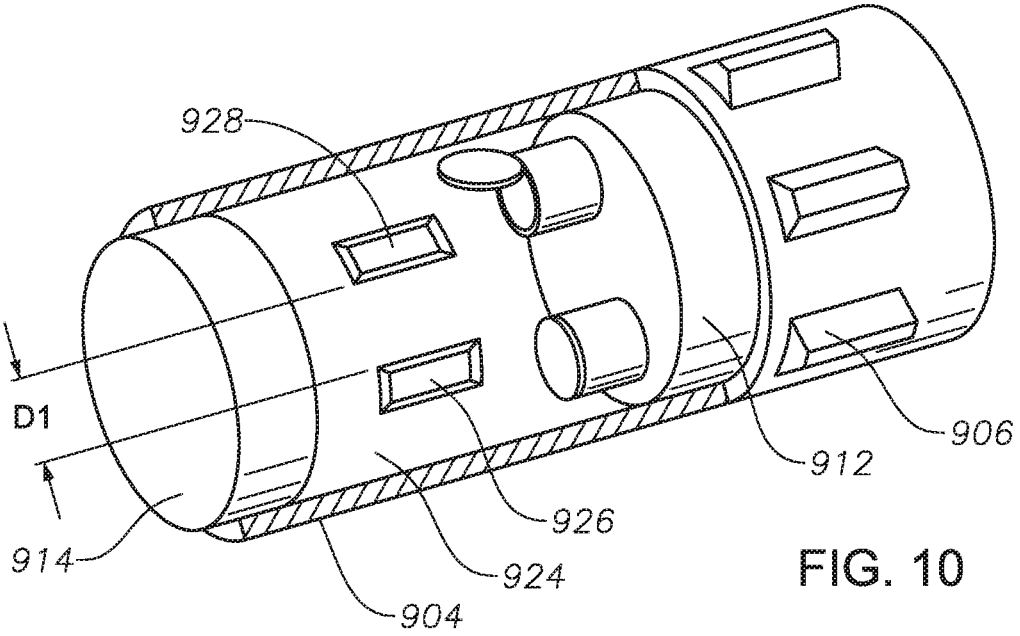
FIG. 10 is an enlarged-view schematic of the tool head from FIG. 9.

FIG. 10 is an enlarged-view schematic of tool head 904 from FIG. 9. As pictured, slots 928 are substantially rectangular in shape and disposed a distance D1 apart around the outer edge of tool head 904. In other embodiments, slots for directing a pressure pulse generated by an exothermic reaction component can be any other shape, such as the substantially circular perforation 708 shown in FIG. 7, and any suitable number and arrangement of any shape perforation around tool head 904 is envisioned.

For instance, on a substantially cylindrical tool head, such as tool head 904, if fracturing were desired in the fashion of substantially perpendicular intersecting vertical planes, four perforations could be disposed around a substantially cylindrical tool head at 90° orientations to one another. More than one set of four perforations could be disposed along the tool head along the length of the tool head with the perforations aligned to create fractures aligned with substantially perpendicular intersecting vertical planes.

Figure 11:
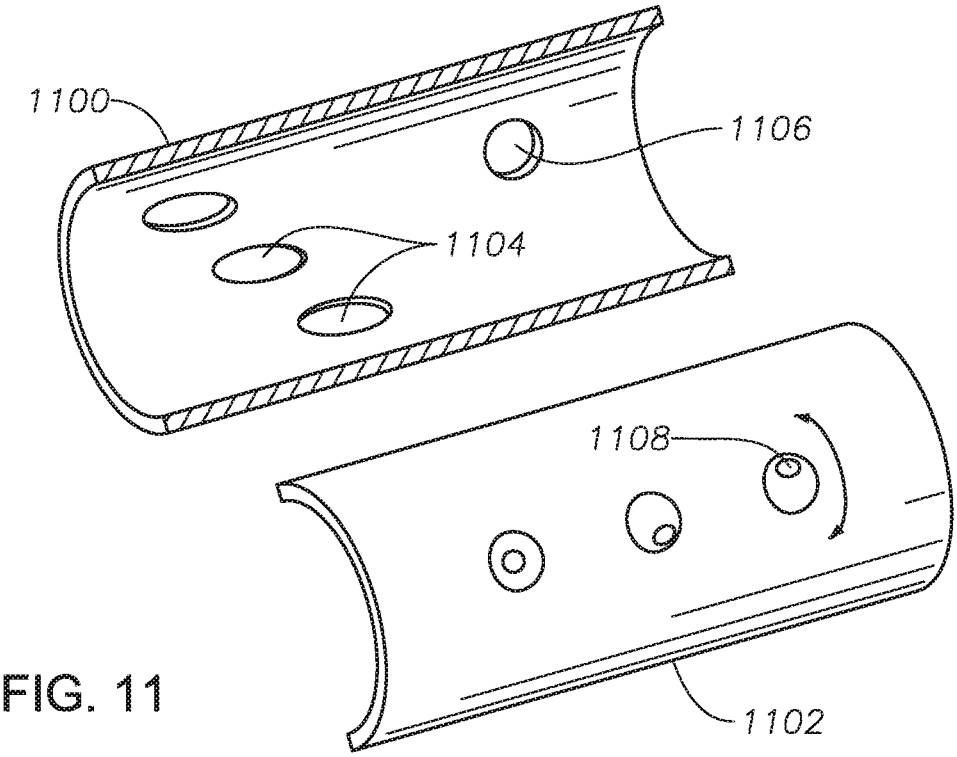
FIG. 11 is a schematic of alternative liners for spatially orienting a chemically-induced pressure pulse using alternative slots and rotational orientation ports.

Referring now to FIG. 11, a schematic is provided of a tool for spatially orienting a chemically-induced pressure pulse showing alternative rupture membranes and rotational orientation ports. Liner 1100 and liner 1102 provide alternate configurations for pre-slotted liner 924 of FIG. 9. For example, liner 1100 includes a series of closely-spaced substantially oval-shaped slots 1104 and substantially circular slots 1106. More or fewer substantially oval-shaped or substantially circle-shaped slots could be used in other embodiments. Substantially oval-shaped rupture membranes fit in slots 1104, and substantially circle-shaped rupture membranes fit in slots 1106.

Liner 1102 includes three rotational orientation ports 1108 positioned in a substantially straight line. The orientation ports are rotatable through a 360° angle as shown by the rotational arrow in FIG. 11. The rotation could be automated or adjusted manually by a user, depending on the desired orientation of the pressure pulse and fracturing. In other embodiments, more or fewer rotational orientation ports could be used, and positioned in any suitable configuration on liner 1102. A suitable configuration would be one in which the desired fracking pattern of a rock is obtained.

Figure 12:
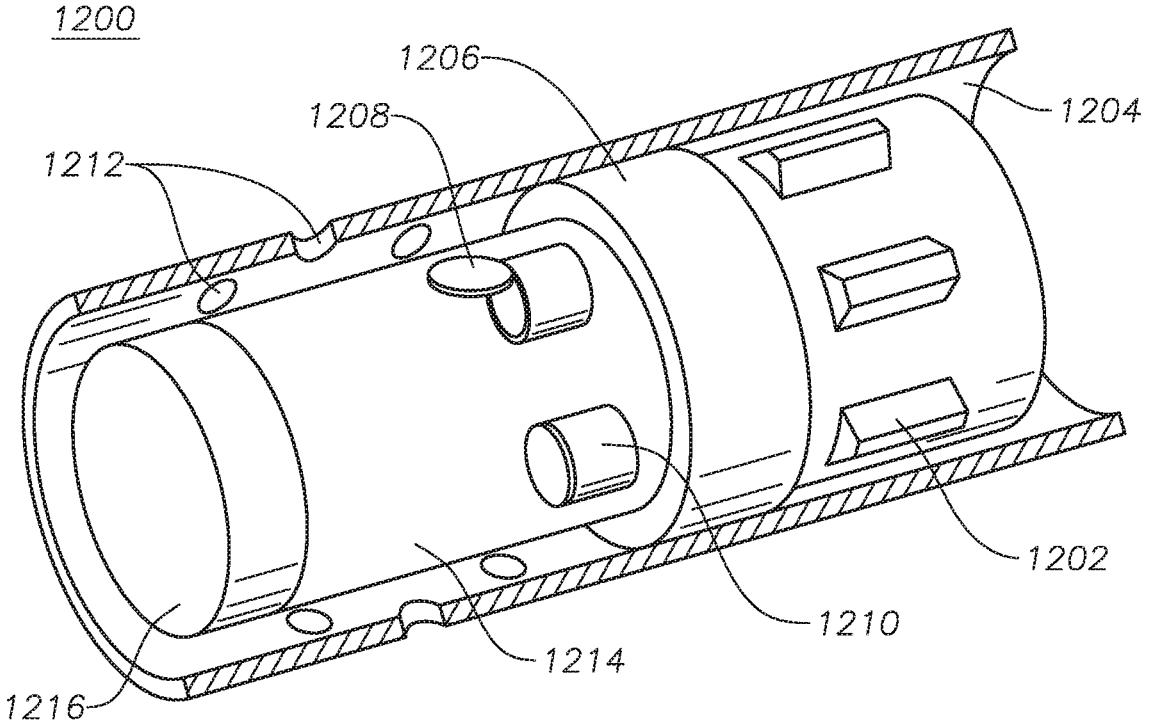
FIG. 12 is a schematic of a tool for spatially orienting a chemically-induced pressure pulse in a cased hole wellbore (wellbore with casing) in a hydrocarbon-bearing formation.

Referring now to FIG. 12, a schematic is provided showing a tool for spatially orienting a chemically-induced pressure pulse in a cased hole wellbore (a wellbore with casing) in a hydrocarbon-bearing formation. Cased hole pressure pulse spatially-orienting tool 1200 includes a centralizer 1202, swellable packers 1206, chemical injection conduits 1208, 1210, a low pressure rupture sleeve 1214 and a reinforced plug 1216. Cased hole pressure pulse spatially-orienting tool 1200 is disposed within casing 1204 in a wellbore, and the exothermic reaction component is injected separately by way of chemical injection conduits 1208, 1210 into low pressure rupture sleeve 1214.

Swellable packers 1206 and reinforced plug 1216 are integrally coupled to either the wellbore or each other, or to the wellbore and each other, such that when low pressure rupture sleeve 1214 ruptures, swellable packers 1206 and reinforced plug 1216 remain in place and a pressure pulse is directed radially outwardly from the tool toward casing 1204. In some embodiments, reinforced plug 1216 has a pressure rating of up to about 2,041 atm (30,000 psi) and remains in place when the pressure pulse is executed.

The pressure pulse and energy released from the exothermic reaction of the exothermic reaction component will cause the low pressure rupture sleeve 1214 to tear, and the energy and pressure pulse is released into the perforations 1212 of the casing 1204. While the perforations 1212 in casing 1204 are substantially circular, perforations in other embodiments can be any other suitable shape, and disposed in any other suitable configuration. A suitable shape and configuration allows for the pressure pulse to be directed in an orientation to achieve the desired fracturing pattern in a formation.

Figure 13:
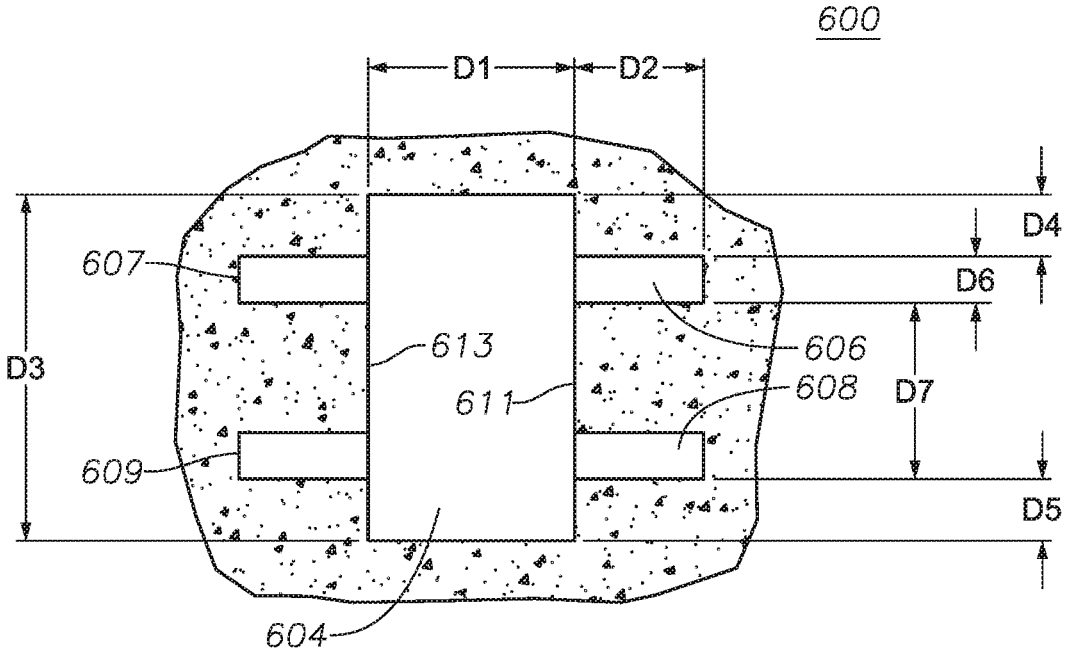
FIG. 13 is a schematic of the open hole cavity of FIG. 6A with measurements provided for directional niches.

Referring now to FIG. 13, a schematic is provided of the open hole cavity of FIG. 6A with measurements provided for directional niches. Directional niches 606, 607, 608, 609 were made on sidewalls 611, 613 of the cavity 604 of the cement sample 600. Directional niches 606, 607, 608, 609 were formed prior to the experiment during casting of the cement sample 600. The experiment exemplifies creating oriented fractures in real open hole oil wells using directional niches. The exothermic reaction component was placed in cavity 604 without any pressure pulse spatially-orienting tool; however, in other embodiments a pressure pulse spatially-orienting tool could be used in conjunction with, before, or after directional niches. For example, perforations on a pressure pulse spatially-orienting tool could be substantially aligned with directional niches before executing a pressure pulse.

In FIG. 13, representing FIG. 6, the diameter D1 is 7.62 cm (3 in), the distance D2 is 2.54 cm (1 in), the distance D3 is 12.7 (5 in), the distance D4 is 2.54 (1 in), the distance D5 is 2.54 (1 in), the distance D6 is 1.27 cm (0.5 in), and the distance D7 is 5.08 cm (2 in). In other embodiments, any other suitable amount, size, configuration, direction, or type of directional niche can be used either with or without a pressure pulse spatially-orienting tool.

Figure 14:
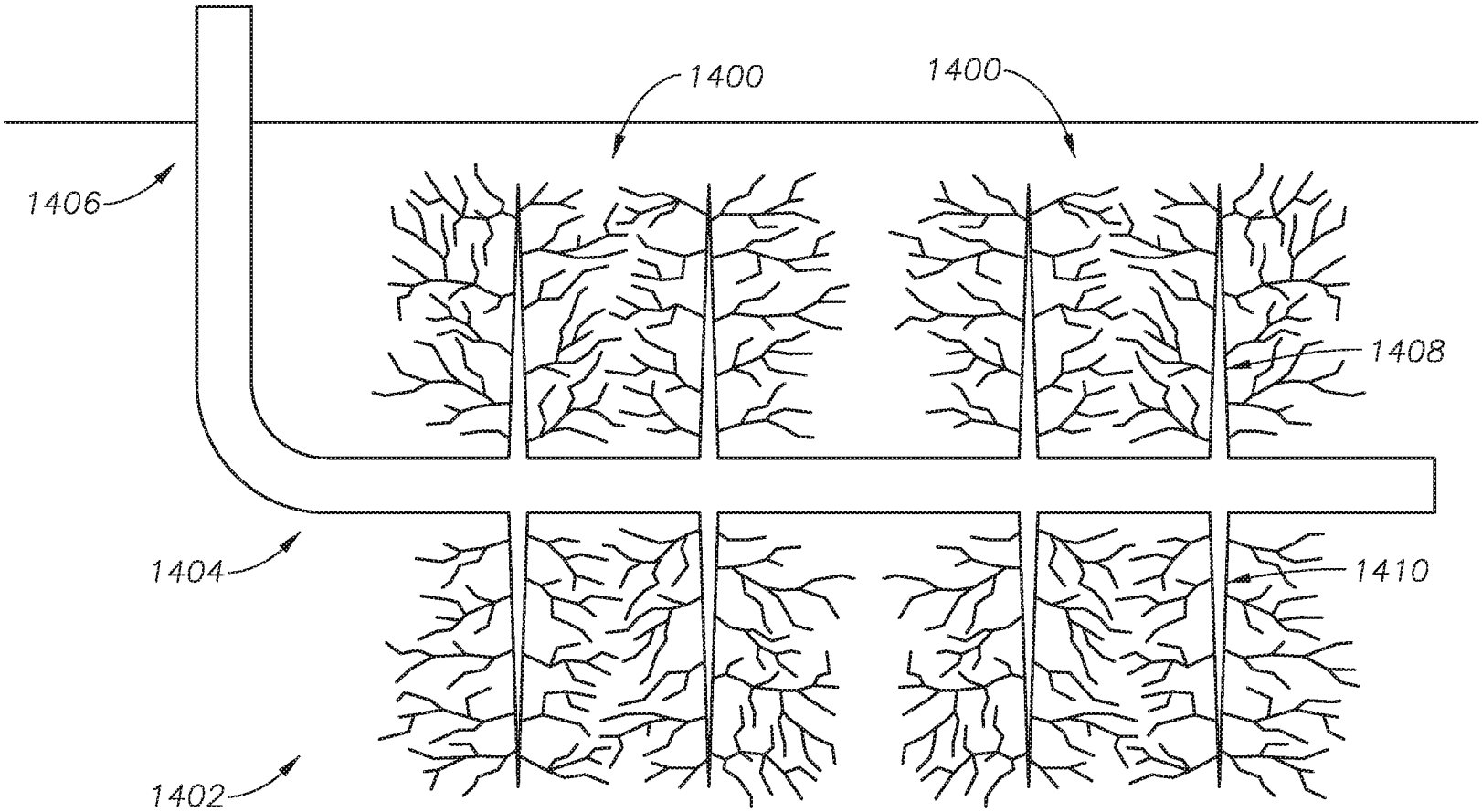
FIG. 14 is a schematic showing multiple fractures creating a fracture network extending radially outwardly from a horizontally-drilled wellbore.

Referring now to FIG. 14, a schematic is provided showing multiple fractures creating a fracture network extending radially outwardly from a horizontally-drilled wellbore. Fractures 1400 form a fracture network 1402. Vertical wellbore 1406 and horizontal wellbore 1404 are shown. Vertically spatially-oriented fractures such as vertically spatially-oriented fractures 1408, 1410 are shown to be substantially parallel with vertical wellbore 1406 and substantially perpendicular relative to horizontal wellbore 1404. Such spatially-oriented fractures can be generated in a cased or open-hole wellbore, using the embodiments of spatially-orienting tools of the present disclosure discussed previously. Other spatial orientations for fractures and fracture networks relative to wellbores can be chosen based on reservoir and wellbore conditions and characteristics. For example, substantially horizontal spatially-oriented fractures could extent radially outward from vertical wellbore 1406 and connect with fracture network 1402.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges may be expressed throughout as from about one particular value, or to about another particular value. When such a range is expressed, it is to be understood that another embodiment is from the one particular value or to the other particular value, along with all combinations within said range.

As used in the specification and in the appended claims, the words "comprise," "has," and "include" and all grammatical variations thereof are each intended to have an open, non-limiting meaning that does not exclude additional elements or steps.

As used throughout the specification and claims, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. An apparatus for spatially orienting a subterranean pressure pulse in a hydrocarbon-bearing formation, the apparatus comprising:

an injection body with a fixed shape, where the injection body is operable to hold an exothermic reaction component prior to triggering an exothermic reaction of the exothermic reaction component, and where the injection body maintains the fixed shape during and after triggering of the exothermic reaction component;

a chemical injection port, where the chemical injection port is operable to feed components of the exothermic reaction component to the injection body;

a reinforced plug, where the reinforced plug is operable to direct a pressure pulse generated by the exothermic reaction component within the injection body to a perforation to generate a spatially-oriented fracture, where spatial orientation of the spatially-oriented fracture is pre-determined; and a rupture sleeve, where the pressure pulse generated by the exothermic reaction component causes the rupture sleeve to tear.

2. The apparatus of claim 1, where the injection body further comprises a rotational orientation port, where the rotational orientation port is adjustable about a 360° rotational angle to direct the pressure pulse.

3. The apparatus of claim 1, where the reinforced plug comprises a first reinforced plug and a second reinforced plug, where the first reinforced plug and the second reinforced plug are operable to direct a pressure pulse generated by the exothermic reaction component within the injection body to the perforation.

4. The apparatus of claim 3, where the first reinforced plug and second reinforced plug are threadingly attachable and detachable from the injection body.

5. The apparatus of claim 1, further comprising a centralizer.

6. The apparatus of claim 1, where the chemical injection port further comprises at least two chemical injection conduits, the chemical injection conduits operable to allow only one way flow into the injection body.

7. The apparatus of claim 1, where the injection body comprises more than one perforation operable to direct the pressure pulse.

8. An apparatus for spatially orienting a subterranean pressure pulse in a hydrocarbon-bearing formation, the apparatus comprising:

an injection body with a fixed shape, where the injection body is operable to hold an exothermic reaction component prior to triggering an exothermic reaction of the exothermic reaction component, where the injection body maintains the fixed shape during and after triggering of the exothermic reaction component, and where the injection body further comprises a liner with a slot;

a chemical injection port, where the chemical injection port is operable to feed components of the exothermic reaction component to the injection body; and a reinforced plug, where the reinforced plug is operable to direct a pressure pulse generated by the exothermic reaction component within the injection body to a perforation to generate a spatially-oriented fracture, where spatial orientation of the spatially-oriented fracture is pre-determined.

9. The apparatus of claim 8, where the slot further comprises a rupture membrane, and where the rupture membrane is operable to rupture upon triggering of the exothermic reaction component.

10. The apparatus of claim 8, where the injection body further comprises a rotational orientation port, where the rotational orientation port is adjustable about a 360° rotational angle to direct the pressure pulse.

11. The apparatus of claim 8, where the reinforced plug comprises a first reinforced plug and a second reinforced plug, where the first reinforced plug and the second reinforced plug are operable to direct a pressure pulse generated by the exothermic reaction component within the injection body to the perforation.

12. The apparatus of claim 11, where the first reinforced plug and second reinforced plug are threadingly attachable and detachable from the injection body.

13. The apparatus of claim 8, further comprising a centralizer.

14. The apparatus of claim 8, where the chemical injection port further comprises at least two chemical injection conduits, the chemical injection conduits operable to allow only one way flow into the injection body.

15. The apparatus of claim 8, where the injection body comprises more than one perforation operable to direct the pressure pulse.

* * * * *